US010792945B2

(12) United States Patent
Hasegawa

(10) Patent No.: US 10,792,945 B2
(45) Date of Patent: Oct. 6, 2020

(54) IMAGE FORMING APPARATUS, CONTROL METHOD OF IMAGE FORMING APPARATUS, BOOKBINDING APPARATUS AND CONTROL METHOD OF BOOKBINDING APPARATUS

(71) Applicant: CANON KABUSHIKI KAISHA, Tokyo (JP)

(72) Inventor: Teppei Hasegawa, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 196 days.

(21) Appl. No.: 16/140,620

(22) Filed: Sep. 25, 2018

(65) Prior Publication Data

US 2019/0092070 A1 Mar. 28, 2019

(30) Foreign Application Priority Data

Sep. 28, 2017 (JP) ..... 2017-188054

(51) Int. Cl.

| | |
|---|---|
| ***B42B 5/10*** | (2006.01) |
| ***B26F 1/14*** | (2006.01) |
| ***B65H 43/06*** | (2006.01) |
| ***B42B 5/12*** | (2006.01) |
| ***B42B 4/00*** | (2006.01) |
| ***B65H 37/04*** | (2006.01) |
| ***B26F 1/38*** | (2006.01) |

(Continued)

(52) U.S. Cl.

CPC ..... *B42B 5/103* (2013.01); *B21F 45/16* (2013.01); *B26F 1/14* (2013.01); *B26F 1/38* (2013.01); *B42B 4/00* (2013.01); *B42B 5/123* (2013.01); *B42C 19/08* (2013.01); *B65H 37/04* (2013.01); *B65H 43/06* (2013.01); *G03G 15/6544* (2013.01); *B65H 2551/20* (2013.01); *B65H 2701/1829* (2013.01)

(58) Field of Classification Search

CPC ..... B42B 5/123; B42B 5/103; B21F 45/16

See application file for complete search history.

(56) References Cited

U.S. PATENT DOCUMENTS

2002/0085897 A1 7/2002 Blattner et al.
2009/0257846 A1* 10/2009 Matsushita ..... B26F 1/0092 412/6
2009/0269167 A1* 10/2009 Iida ..... B42B 5/103 412/7

FOREIGN PATENT DOCUMENTS

JP 2009190180 A 8/2009

* cited by examiner

*Primary Examiner* — Jennifer E Simmons
(74) *Attorney, Agent, or Firm* — Rossi, Kimms & McDowell LLP

(57) ABSTRACT

An image forming apparatus, including: a printing unit configured to print on a sheet; a bookbinding unit configured to perform a cutting process of cutting a binding member for binding a plurality of sheets before sheets printed by the printing unit are stacked on a stack tray and perform a binding process of binding the sheets by the cut binding member; and a controller configured to cause the bookbinding unit to perform the cutting process of the binding member based on sheet size information, the controller controls, in a case of producing a plurality of copies of bookbound products, not to perform the cutting process of the binding member of a second copy while sheets are stacking as a first copy, but to perform the cutting process of the binding member of a next copy while sheets are stacking as each of the second copy and subsequent copies.

13 Claims, 16 Drawing Sheets

(51) Int. Cl.

| | |
|---|---|
| ***B21F 45/16*** | (2006.01) |
| ***B42C 19/08*** | (2006.01) |
| ***G03G 15/00*** | (2006.01) |

FIG. 10

THE JOB WAS CANCELED BECAUSE AN ERROR OCCURRED DURING RING BINDING PROCESS.
PLEASE REMOVE ALL BINDING MEMBERS AND SHEETS UNDER PROCESSING.
PLEASE CHECK JOB SETTING AND TYPE OF BINDING MEMBER.

CLOSE

IMAGE FORMING APPARATUS, CONTROL METHOD OF IMAGE FORMING APPARATUS, BOOKBINDING APPARATUS AND CONTROL METHOD OF BOOKBINDING APPARATUS

BACKGROUND OF THE INVENTION

Field of the Invention

The present invention relates to an image forming apparatus configured to perform a ring bookbinding process, a bookbinding apparatus, and control methods of the image forming apparatus and the bookbinding apparatus.

Description of the Related Art

Some of image forming apparatuses perform a bookbinding process of case bookbinding, saddle stitch bookbinding, ring bookbinding and the like by post-processing apparatuses that are connected. As one of post-processing functions executed by image forming apparatuses, a ring bookbinding process function is cited. The ring bookbinding process function is to obtain a bookbound product by applying a punching (punch) process to respective printed sheets, inserting ring-shaped binding members into punched holes punched by the punching process, and binding the sheets. The process is called a ring bookbinding process, a wire bookbinding process and the like from the shape of the binding member used in the binding process.

There is known a ring bookbinding device that generates a bookbound product by cutting a binding member in accordance with a sheet size immediately before the bookbinding process in order to perform ring bookbinding of books of various sheet sizes and thicknesses by using one binding member (U.S. Patent Application Publication No. 2002/0085897, Japanese Patent Application Laid-Open No. 2009-190180).

When a ring bookbound product is produced in an image forming apparatus of a configuration in which a printer and a ring bookbinding device are connected, a cutting process of a binding member is necessary before sheet stacking is started in the ring bookbinding device, and a binding process is also necessary after completion of sheet stacking. Consequently, even when the printer has the ability to pint at a high speed, it is necessary to stop the printing process of the printer or decrease the speed of the printing process while performing a cutting process and a binding process of the binding member. Note that if the ring bookbinding device performs sheet stacking and the cutting process of the binding member of the next copy in parallel, the entire processing time can be shortened by cutting the binding member to be used in the next copy in advance during sheet stacking.

However, the number of sheets, the sheet size and the like for which ring bookbinding process is possible are limited, and if sheet stacking and the binding process cannot be completed normally, the bookbinding process may be cancelled. In that case, there arises the problem that the binding member for the next copy that is cut in advance is wasted.

SUMMARY OF THE INVENTION

The present disclosure is provided of solving the above described problem. The present disclosure is to provide a mechanism that can shorten a processing time required for a ring bookbinding printing process of a plurality of copies, and prevents a binding member from being wasted.

An image forming apparatus of one embodiment of the present disclosure, comprising:

a printing unit configured to print on a sheet based on print job;

a bookbinding unit including a stack tray on which a plurality of printed sheets are stacked and configured to perform a cutting process of cutting a binding member for binding the plurality of sheets in accordance with a size of the sheets before the sheets on which printing is performed by the printing unit are stacked on the stack tray and perform a binding process of binding stacked sheets by the binding member which is cut; and a controller configured to cause the bookbinding unit to perform the cutting process of the binding member based on sheet size information included in the print data, wherein in a case where the controller controls to produce a plurality of copies of bookbound products on each of which the binding process is performed, the controller controls not to perform the cutting process of the binding member to be used in the binding process of a second copy while sheets are stacking as a first copy, but to perform the cutting process of the binding member to be used in the binding process of a next copy while sheets are stacking as each of the second copy and subsequent copies.

Further features of the present invention will become apparent from the following description of exemplary embodiments with reference to the attached drawings.

BRIEF DESCRIPTION OF THE DRAWINGS

FIG. 10 is a diagram illustrating an error screen that is displayed when an error occurs.

DESCRIPTION OF THE EMBODIMENTS

Hereinafter, embodiments for carrying out the present invention will be described with use of the drawings. In the following explanation, an external controller may be referred to as an image processing controller, a digital front end, a print server, a DFE and the like. An image forming apparatus may be referred to as a multifunctional peripheral, and an MFP.

Embodiment 1

<Entire Configuration of Image Processing System>

Figure 1:
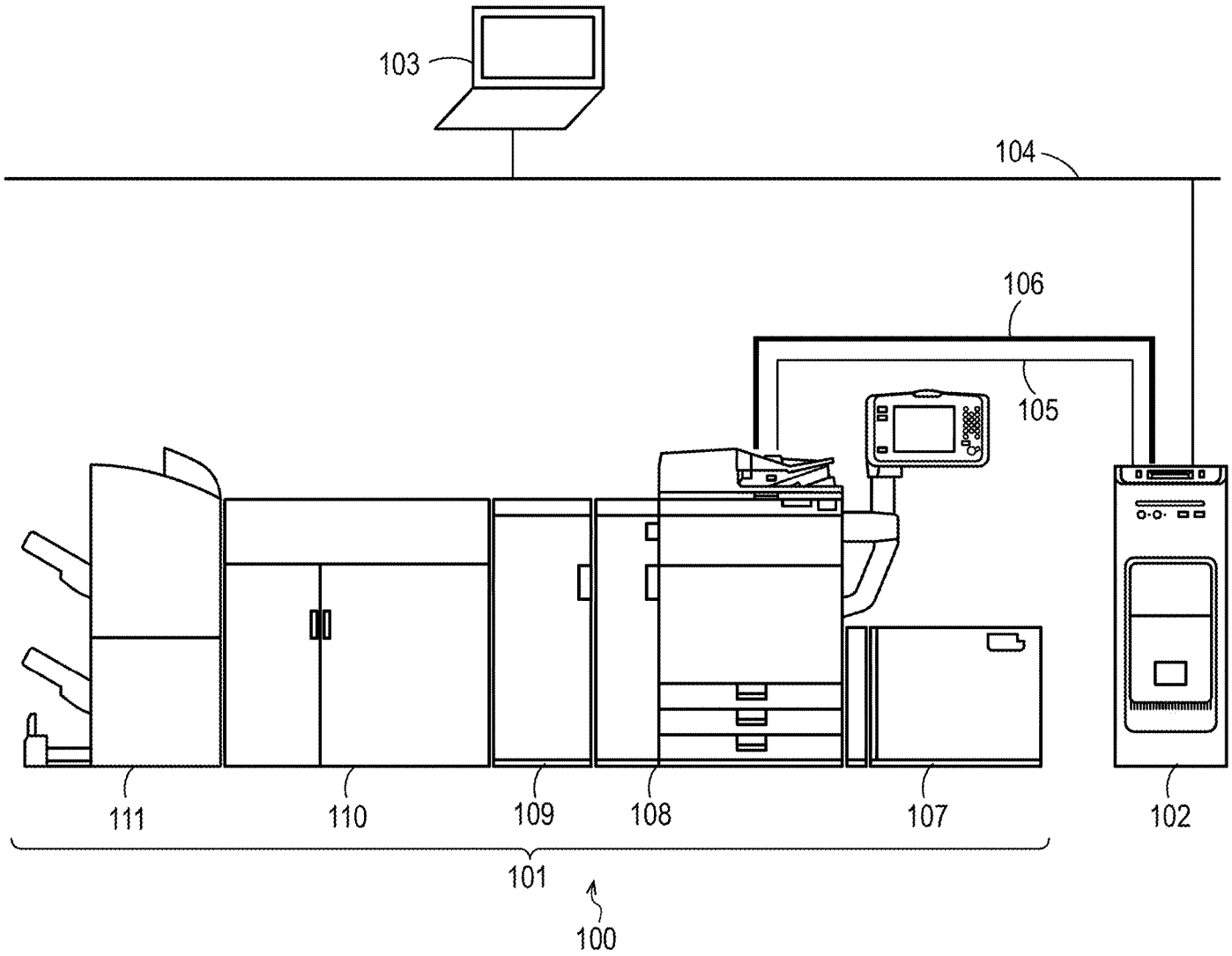
FIG. 1 is a view illustrating a configuration of an image processing system illustrating a present embodiment.

FIG. 1 is a view illustrating an example of a configuration of an image processing system illustrating one embodiment of the present invention. An image processing system 100 of the present embodiment includes an image forming apparatus 101 and an external controller 102. The image forming apparatus 101 and the external controller 102 are communicatively connected via an internal LAN 105 and a video cable 106. Further, the external controller 102 is communicatively connected to a client PC 103 via an external LAN 104, and a print instruction is issued to the external controller 102 from the client PC 103.

The client PC 103 is configured by a personal computer, for example. In the client PC 103, a printer driver having a function of converting print data into a print description language to be processed in the external controller 102 is installed. A user who performs printing can issue a print instruction from various applications in the client PC 103 via the printer driver. The printer driver transmits print data to the external controller 102 based on the print instruction from the user. When the external controller 102 receives the print instruction from the client PC 103, the external controller 102 performs analysis and a rasterizing process of print data included in the print instruction, and inputs the print data to the image forming apparatus 101 and issue a print instruction.

Next, the image forming apparatus 101 will be described.

In the image forming apparatus 101, a plurality of devices having different functions (a feeder 107, a printer 108, a puncher 109, a ring bookbinding device 110, a discharge device 111 and the like) are connected, and are configured to perform a complicated printing process such as bookbinding.

The feeder 107 is a device that stacks sheets for printing in the image forming apparatus 101. The feeder 107 includes a plurality of feeding portions, and it is possible to set different sheets in the respective feeding portions.

The printer 108 forms an image onto a sheet that is conveyed from the feeder 107 or a feeding portion located at a lower portion of the printer 108 by using a toner. A configuration and an operating principle of the printer 108 are as follows. A light beam such as laser light that is modulated in accordance with image data is reflected by a rotary polygon mirror such as a polygon mirror to irradiate a photosensitive drum as scanning light. An electrostatic latent image formed on the photosensitive drum by the laser light is developed by a toner. The toner image is transferred onto a sheet stuck on a transfer drum. By sequentially executing the series of image forming processes to toners of yellow (Y), magenta (M), cyan (C) and black (K), a full-color image is formed on the sheet. The sheet on the transfer drum on which the full-color image is formed is conveyed to a fixing device. The fixing device includes a roller, a belt and the like, contains a heat source such as a halogen heater in the roller, and melts the toner on the sheet on which the toner image is transferred by heat and pressure to fix the toner onto the sheet.

The puncher 109 is a device for applying a punching process to the conveyed sheet.

The ring bookbinding device 110 obtains a ring bound product by stacking sheets so that punched portions of punched sheets worked by the puncher 109 penetrate through the binding members, and further deforming and working the binding members into a ring shape. The discharge device 111 is a device that stacks printed sheets. In some of the discharge devices 111, devices configured to perform post process such as a punching process, a binding process and a folding process may be incorporated.

In a configuration of the image forming apparatus 101 described in FIG. 1, sheets to which ring bookbinding instruction is applied are stacked in a discharge portion of the ring bookbinding device 110, and the other sheets are stacked in the discharge device 111. Note that as the devices connectable to the image forming apparatus 101, besides the aforementioned devices, a sheet insertion device for inserting sheets, a case bookbinding apparatus for performing case bookbinding and the like are present other than what are illustrated in FIG. 1. The image forming apparatus of the present embodiment is not limited to the configuration illustrated in FIG. 1.

Further, the image processing system 100 described in FIG. 1 has the configuration in which the external controller 102 is connected to the image forming apparatus 101, but is not limited to the configuration in which the external controller 102 is connected. That is, a configuration may be adopted, in which the image forming apparatus 101 is connected to the external LAN 104, and print data that can be processed by the image forming apparatus 101 is transmitted from the client PC 103. In this case, in the image forming apparatus 101, data analysis and a rasterizing process are performed, and a printing process is executed.

<Functional Configuration of Image Processing System>

Figure 2:
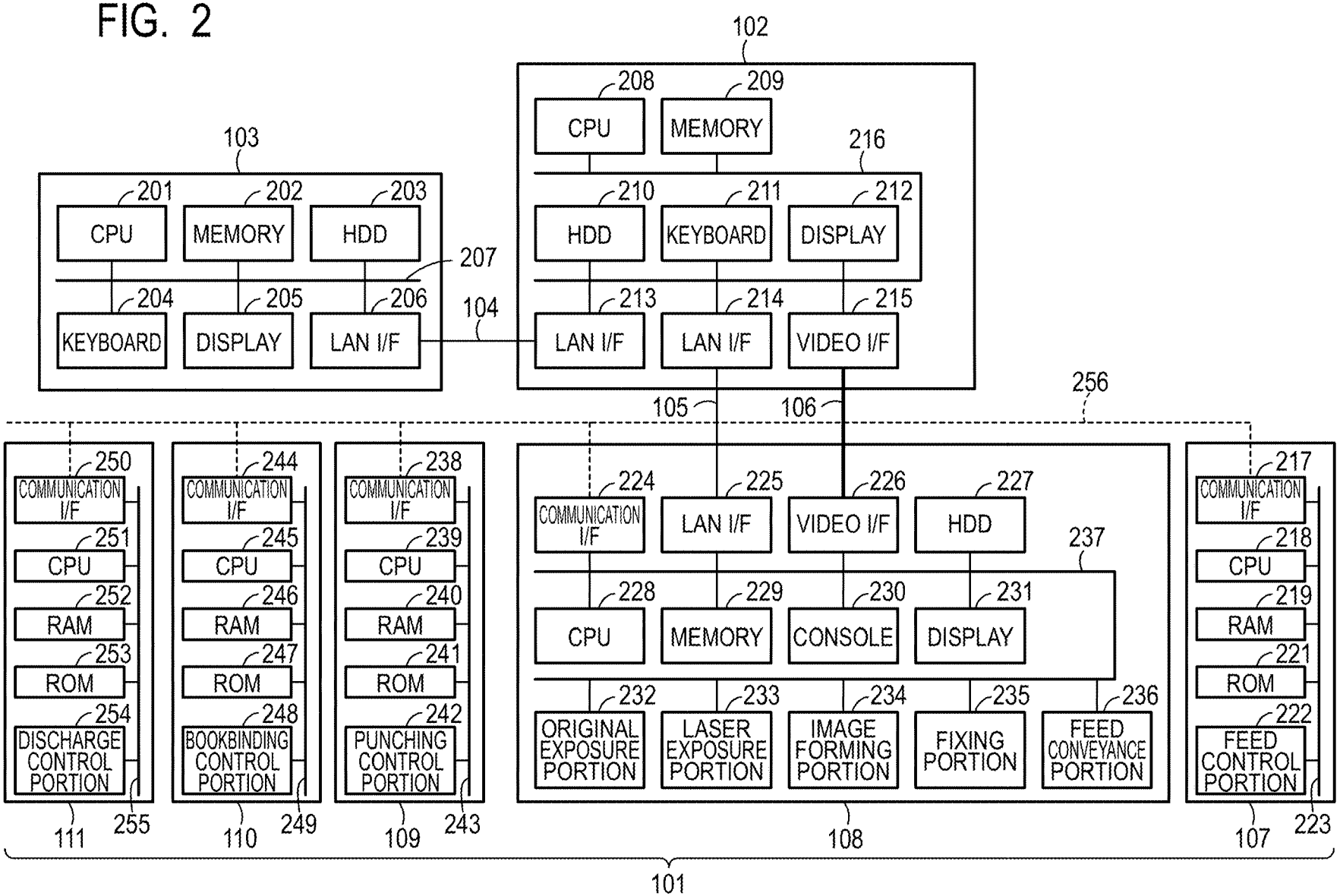
FIG. 2 is a diagram illustrating configurations of an image forming apparatus, an external controller and a client PC.

FIG. 2 is a block diagram illustrating an example of a system configuration of the image forming apparatus 101, the external controller 102 and the client PC 103. First, a configuration of the printer 108 of the image forming apparatus 101 will be described. The printer 108 of the image forming apparatus 101 includes a communication I/F 224, a LAN I/F 225, a video I/F 226, an HDD 227, a CPU 228, a memory 229, a console 230 and a display 231. Further, the image forming apparatus 101 includes an original exposure portion 232, a laser exposure portion 233, an image forming portion 234, a fixing portion 235 and a feed conveyance portion 236. The respective components 224 to 236 are connected via a system bus 237.

The communication I/F 224 is connected to the feeder 107, the puncher 109, the ring bookbinding device 110 and the discharge device 111 via a communication cable 256, and performs communication for control of the respective devices. The LAN I/F 225 is connected to the external controller 102 via the internal LAN 105, and performs communication such as reception of print data. The video I/F 226 is connected to the external controller 102 via the video cable 106, and performs communication such as reception of image data.

The HDD 227 is a storage apparatus (for example, a hard disk drive) for storing programs and data. The CPU 228 comprehensively performs image processing control and control of printing based on the programs and the like stored in the HDD 227. The memory 229 stores programs that are necessary for the CPU 228 to perform various processes, and image data, and operates as a work area. The console 230 accepts input of various settings and an instruction of operation from a user. The display 231 displays setting information on the image forming apparatus, a processing situation of a print job and the like.

The original exposure portion 232 performs a process of reading an original at a time of using a copy function and a scan function. The original exposure portion 232 reads original data by photographing an image with a CCD camera, while illuminating a sheet set by the user with an exposure lamp.

The laser exposure portion 233 is a device that performs primary charge for irradiating the photosensitive drum with laser light to transfer a toner image, and laser exposure. The laser exposure portion 233 firstly performs primary charge that charges a photosensitive drum surface to a uniform negative electric potential. Next, the laser exposure portion 233 irradiates the photosensitive drum with laser light by a laser driver while adjusting a reflection angle with a polygon mirror. Thereby, negative electric charges in the irradiated portion are neutralized and an electrostatic latent image is formed on the photosensitive drum.

The image forming portion 234 is a device for transferring a toner to a sheet, is configured by a developing unit, a transfer unit, a toner supply portion and the like, develops an electrostatic latent image on the photosensitive drum with the toner, and transfers the toner on the photosensitive drum to the sheet. The developing unit attaches a toner negatively electrified to the electrostatic latent image on the photosensitive drum surface from a development cylinder, and visualizes the electrostatic latent image. The transfer unit performs primary transfer that applies a positive electric potential to the primary transfer roller to transfer the toner on the photosensitive drum surface to the transfer belt, and transfer that applies a positive electric potential to a secondary transfer outer roller to transfer the toner on the transfer belt to a sheet.

The fixing portion 235 is a device for fusing and fixing the toner which is on the sheet, to the sheet with heat and pressure, and is configured by a heating heater, a fixing belt, a pressure belt and the like. The feed conveyance portion 236 is a device for conveying sheets, and a feeding operation, and a conveyance operation of the sheets are controlled by rollers and various sensors.

Next, a configuration of the feeder 107 of the image forming apparatus 101 will be described. The feeder 107 of the image forming apparatus 101 includes a communication I/F 217, a CPU 218, a RAM 219, a ROM 221 and a feed control portion 222. The respective components 217 to 222 are connected via a system bus 223.

The communication I/F 217 is connected to the printer 108 via the communication cable 256 and performs communication necessary for control. The CPU 218 performs various kinds of control necessary for feeding in accordance with a control program stored in the ROM 221. To the RAM 219, programs that are necessary when the CPU 218 performs various processes are read from the ROM 221, and the RAM 219 operates as a work area. The ROM 221 is a storage device in which the control program is stored. The feed control portion 222 controls feed and conveyance of sheets while controlling rollers and sensors based on an instruction from the CPU 218.

Next, a configuration of the puncher 109 of the image forming apparatus 101 will be described. The puncher 109 of the image forming apparatus 101 is configured by a communication I/F 238, a CPU 239, a RAM 240, a ROM 241 and a punching control portion 242. The respective components 238 to 242 are connected via a system bus 243.

The communication I/F 238 is connected to the printer 108 via the communication cable 256, and performs communication necessary for control. The CPU 239 performs various kinds of control necessary for punching in accordance with a control program stored in the ROM 241. To the RAM 240, programs that are necessary when the CPU 239 performs various processes are read from the ROM 241, and the RAM 240 operates as a work area. The ROM 241 is a storage device in which the control program is stored. The punching control portion 242 controls a punching process to the conveyed sheet based on an instruction from the CPU 239. Details of a process of the puncher 109 will be described later with FIG. 3.

Next, a configuration of the ring bookbinding device 110 of the image forming apparatus 101 will be described. The ring bookbinding device 110 of the image forming apparatus 101 includes a communication I/F 244, a CPU 245, a RAM 246, a ROM 247 and a bookbinding control portion 248. The respective components 224 to 248 are connected via a system bus 249.

The communication I/F 244 is connected to the printer 108 via the communication cable 256, and performs communication necessary for control. The CPU 245 performs various kinds of control necessary for ring bookbinding in accordance with a control program stored in the ROM 247. To the RAM 246, programs that are necessary when the CPU 245 performs various processes are read from the ROM 247, and the RAM 246 operates as a work area. The ROM 247 is a storage device in which the control program is stored. The bookbinding control portion 248 controls cutting of a binding member, a conveyance process, a penetration process to the punched portions of the sheets, a binding process by working, and a conveyance process to a sheet stacking portion based on an instruction from the CPU 245. Details of a process of the ring bookbinding device 110 will be described later with FIG. 3.

Next, a configuration of the discharge device 111 of the image forming apparatus 101 will be described. The discharge device 111 of the image forming apparatus 101 includes a communication I/F 250, a CPU 251, a RAM 252, a ROM 253 and a discharge control portion 254. The respective components 250 to 254 are connected via a system bus 255.

The communication I/F 250 is connected to the printer 108 via the communication cable 256, and performs communication necessary for control. The CPU 251 performs various kinds of control necessary for feeding in accordance with a control program stored in the ROM 253. To the RAM 252, programs that are necessary when the CPU 251 performs various processes are read from the ROM 253, and the RAM 252 operates as a work area. The ROM 253 is a storage device in which a control program is stored. The discharge control portion 254 controls conveyance and discharge of sheets while controlling rollers and sensors based on an instruction from the CPU 251.

Next, a configuration of the external controller 102 will be described. The external controller 102 includes a CPU 208, a memory 209, an HDD 210, a keyboard 211, a display 212, a LAN I/F 213, a LAN I/F 214 and a video I/F 215. The respective components 208 to 215 are connected via a system bus 216.

The CPU 208 comprehensively executes processes such as reception of print data from the client PC 103, a RIP process, and transmission of print data to the image forming apparatus 101 based on programs and data stored in the HDD 210. Programs and data that are necessary when the CPU 208 performs various processes are stored in the memory 209, and the memory 209 operates as a work area. Programs and data necessary for operation of a printing process and the like are stored in the HDD 210. The keyboard 211 is a device for inputting an operation instruction of the external controller 102. The display 212 displays information on execution application and the like of the external controller 102 by video signals of a still image and a moving image. The LAN I/F 213 is connected to the client PC 103 via the external LAN 104, and performs communication such as reception of a print instruction. The LAN I/F 214 is connected to the image forming apparatus 101 via the internal LAN 105, and performs communication such as transmission of a print instruction. The video I/F 215 is connected to the image forming apparatus 101 via the video cable 106, and performs communication such as transmission of print data.

Next, a configuration of the client PC 103 will be described. The client PC 103 includes a CPU 201, a memory 202, an HDD 203, a keyboard 204, a display 205, and a LAN I/F 206. The respective components 201 to 206 are connected via a system bus 207.

The CPU 201 executes creation of print data and a print instruction based on a document processing program or the like stored in the HDD 203. Further, the CPU 201 comprehensively controls the respective devices that are connected to the system bus. Programs and data which are necessary when the CPU 201 performs various processes are stored in the memory 202, and the memory 202 operates as a work area. Programs and data which are necessary for operation of a printing process or the like are stored in the HDD 203. The keyboard 204 is a device for inputting an operation instruction of the client PC 103. Display 205 displays information on an execution application and the like of the client PC 103 by video signals of a still image and a moving image. The LAN I/F 206 is connected to the external LAN 104, and performs communication such as transmission of a print instruction.

In the above explanation, the internal LAN 105 and the video cable 106 are connected to the external controller 102 and the image forming apparatus 101, but any configuration in which the data necessary for printing can be transmitted and received can be adopted, and a connection configuration with only the video cable, for example, may be adopted. Further, the memory 202, the memory 209, the memory 229, the RAM 219, the RAM 240, the RAM 246, the RAM 252, the ROM 221, the ROM 241, the ROM 247 and the ROM 253 can be respectively storage devices for holding data and programs. For example, a configuration may be adopted, in which a volatile RAM, a nonvolatile ROM, an internal HDD, an external HDD, an SSD, a USB memory and the like are substituted for the above storage devices.

<Configurations of Puncher 109 and Ring Bookbinding Device 110>

Figure 3:
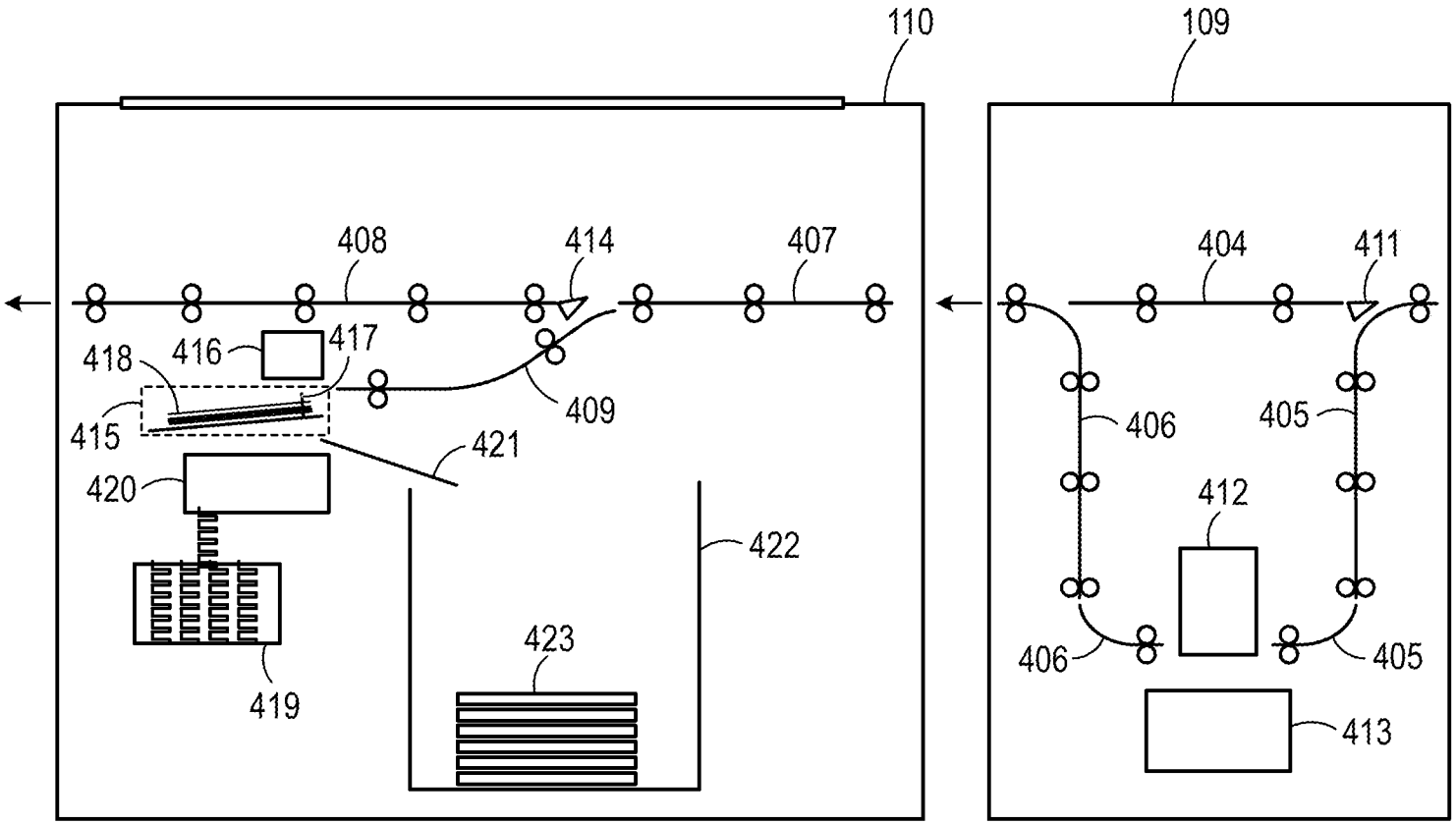
FIG. 3 is a schematic view illustrating configurations of a puncher and a ring bookbinding device.

FIG. 3 is a schematic view illustrating configurations of the puncher 109 and the ring bookbinding device 110. Note that a pair of circular members illustrated in FIG. 3 show rollers for conveying sheets.

A sheet that is printed by the printer 108 is guided to the puncher 109. The sheet guided to the puncher 109 is guided to a different conveyance path in accordance with presence or absence of a punching process. That is, when the sheet does not require a punching process by the puncher 109, the sheet is guided into the ring bookbinding device 110 which is a device in a subsequent stage via a conveyance path 404. On the other hand, when the sheet requires the punching process by the puncher 109, the sheet is guided to a working portion 412 via a conveyance path 405. As for switch of the conveyance path to the sheet, the sheet is controlled to a position where the sheet is guided to a predetermined conveyance path by a flapper 411.

In the working portion 412, the punching process is executed to predetermined positions of the guided sheet. A chad stacking portion 413 is a spot where chad are accumulated. The sheet which is worked by the working portion 412 is guided into the ring bookbinding device 110 that is a device in a subsequent stage via a conveyance path 406.

The sheet which is guided into the ring bookbinding device 110 is conveyed on a conveyance path 407, and thereafter is guided to a different conveyance path in accordance with presence or absence of a bookbinding process by the ring bookbinding device 110. The conveyance path is switched by a flapper 414 being controlled to a position where the sheet is guided to a predetermined conveyance path. That is, when the sheet does not require the bookbinding process, the sheet is discharged to a device in a subsequent stage via a conveyance path 408. On the other hand, when the sheet requires the bookbinding process, the sheet is controlled to be guided to a conveyance path 409.

The sheet which is guided to the conveyance path 409 is guided to a sheet stacking portion 415 and is stacked. In the sheet stacking portion 415, a binding member 417 and a stacked sheet 418 are shown. Though details will be described later, the bookbinding process of the present embodiment adopts a method that obtains a bookbound product by stacking the sheets so that punched portions of the sheets to which punching work is applied by the punching process penetrate through the binding member 417 and further deforming and working the binding member 417 into a ring shape. Accordingly, the sheet that is guided to the sheet stacking portion 415 via the conveyance path 409 needs to be the sheet to which the punching process is applied according to a predetermined mode. Specifically, the sheet needs to be the one subjected to the punching process in accordance with the form in which the binding member 417 can be penetrated through the punched portions of the punched sheet. The binding member 417 and the mode of the punching process will be described later.

A binding member supply portion 420 cuts the binding member 417 after drawing out the binding member 417 by a length necessary for working of the sheet from a holding portion 419 of the binding member 417, and disposes the binding member 417 accurately in a predetermined position of the aforementioned sheet stacking portion 415 (binding member cutting process). When stacking of all the sheets requiring the ring bookbinding process is completed, a deforming work process of the binding member 417 is performed by a working portion 416 (binding process). As a result of the device and process, a bookbound product to which the binding process is applied is obtained. The completed bookbound product is guided to a product tray 422 via a conveyance path 421. FIG. 3 illustrates a state where the completed bookbound products 423 are stored in the tray 422.

Figure 4A:
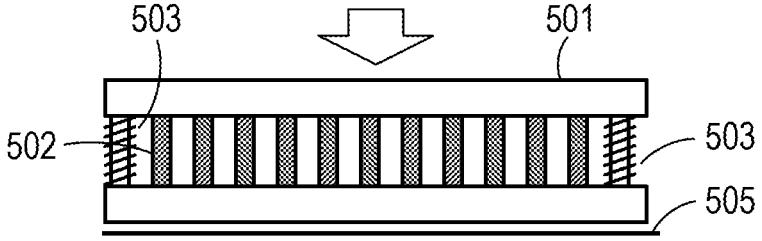
FIGS. 4A, 4B, 4C and 4D are views describing details of a punching process that is applied to a sheet by the puncher.

FIGS. 4A, 4B, 4C and 4D are views describing details of the punching process that is applied to a sheet by the working portion 412 of the puncher 109. In the working portion 412, a component (die 501) called a die and configured to exchange a type of punching holes is disposed. A working target sheet 505 is a sheet to be worked, and shows a sheet that is guided to the working portion 412 via the conveyance path 405 in FIG. 3. As illustrated in FIG. 4A, disposition of a punching portion 502 is firmly fixed by support columns 503, and by applying pressure from above the die 501, the punching portion 502 is pushed out downward. A tip end of the punching portion 502 is in a sharp shape suitable for the punching process, and the punching process is performed for a sheet 505 disposed under the die 501. Various dies 501 are prepared in accordance with a shape and a number of punched holes and the like such as the dies 501 for two holes and multiple holes, besides the dies suitable for the ring bookbinding process, and are configured to be exchangeable.

Figure 4B:
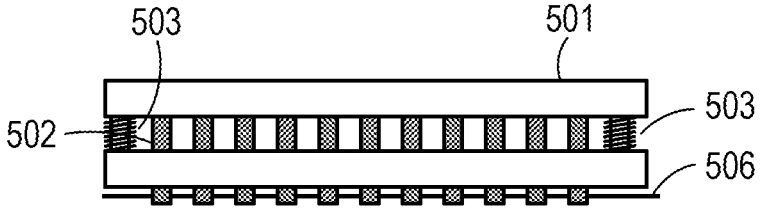
Figure 4C:
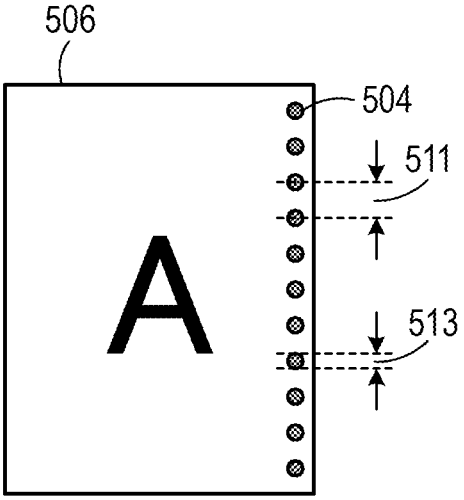
Figure 4D:
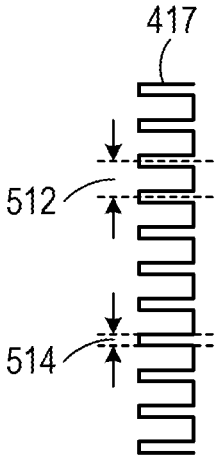

Punching work needs to be applied to a sheet 506 illustrated in FIG. 4B by the die 501 suitable for a ring bookbinding process. Specifically, a size and a spacing of punched holes have to correspond to those of the binding member 417 (FIG. 4D). A spacing 511 of the punched holes (FIG. 4C) and a spacing 512 of the penetration portions of the binding member 417 correspond to each other, and a size 514 of the penetration portion of the binding member 417 has to be smaller than a size 513 of the punched hole 504. This is because in the binding process in the ring bookbinding device 110, the sheet is stacked so that the punched portion of the sheet 506 is fitted over the binding member 417, and a process of deforming the binding member 417 is further required.

Figure 5A:
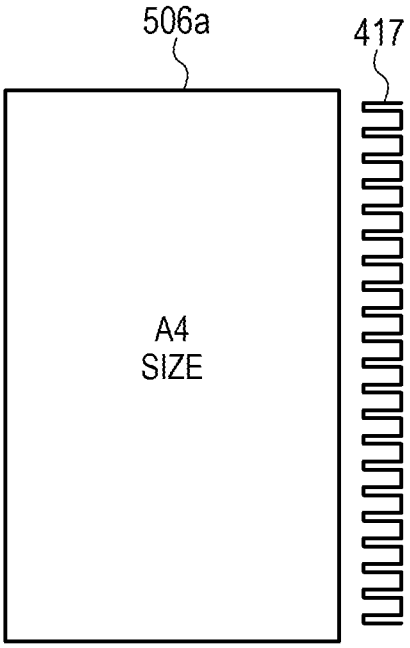
FIGS. 5A, 5B, 5C and 5D are views illustrating relationships between lengths of binding members and sheet sizes.
Figure 5B:
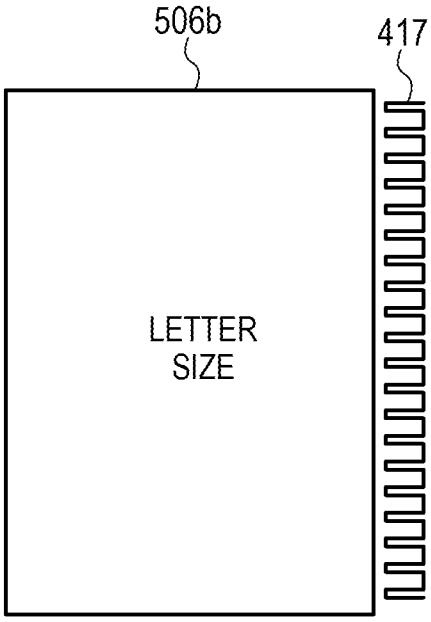
Figure 5C:
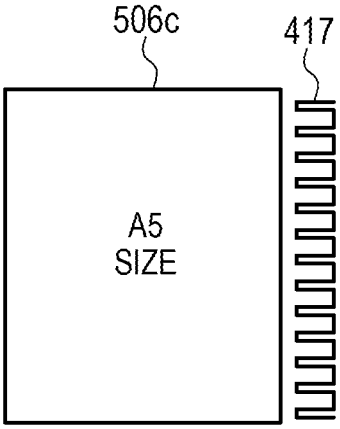
Figure 5D:
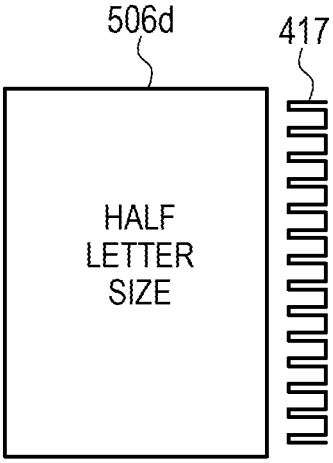

FIGS. 5A, 5B, 5C and 5D are views illustrating relationships between lengths of the binding members 417 and sheet sizes. FIG. 5A is a view illustrating an A4 size sheet 506*a* and the binding member 417. FIG. 5B is a view illustrating a letter size sheet 506*b* and the binding member 417. FIG. 5C is a view illustrating an A5 size sheet 506*c* and the binding member 417. FIG. 5D is a view illustrating a half letter size sheet 506*d* and the binding member 417. The binding member 417 is used in common to all the sheet sizes, so that the spacing 512 between the penetration portions and the size 514 of the penetration portion in FIG. 4D do not change for any sheet size. As illustrated in FIGS. 5A to 5D, the length by which the binding member 417 is cut is adjusted in accordance with the sheet size, and thereby a product matched with the sheet size can be obtained.

FIGS. 6A, 6B, 6C and 6D are schematic views illustrating an example of a vicinity of the sheet stacking portion 415, and are for describing an outline of a mechanism of the ring bookbinding process in the present embodiment.

Figure 6A:
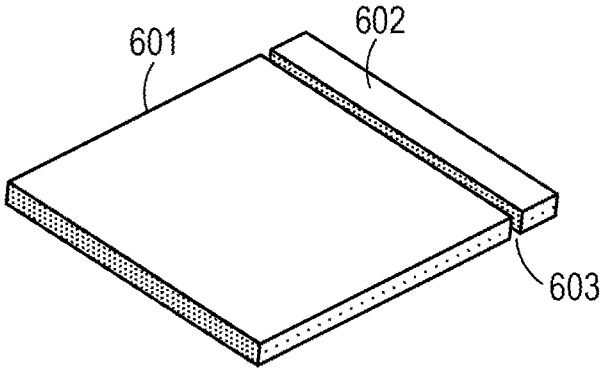
FIGS. 6A, 6B, 6C and 6D are schematic views of an example of a vicinity of a sheet stacking portion.

FIG. 6A illustrates a state of the sheet stacking portion 415 before start of the process. Binding member fixing tools 602 and 601 as a stack tray on which a plurality of sheets are stacked are disposed in parallel. In a gap 603 between the binding member fixing tools 602 and 601, the binding member 417 that is cut in accordance with the sheet size is disposed and fixed.

Figure 6B:
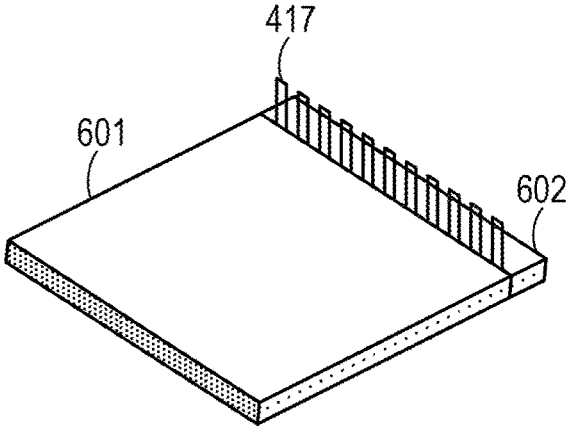
Figure 6C:
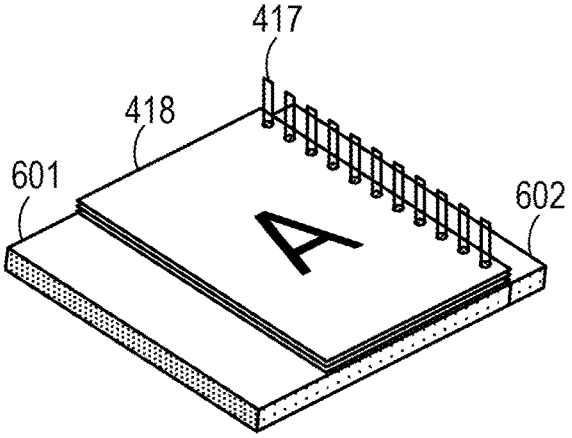
Figure 6D:
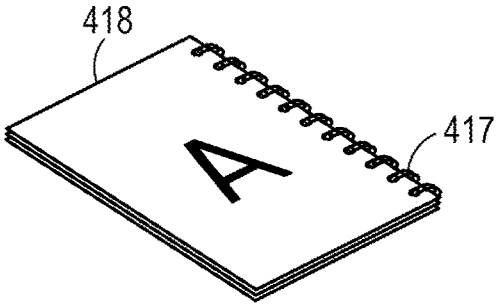

FIG. 6B illustrates a state of the sheet stacking portion 415 after the binding member 417 is supplied. As in FIG. 6B, after the binding member 417 is supplied to the sheet stacking portion 415, the binding member 417 is accurately disposed and fixed in a predetermined position by the binding member fixing tools 602 and 601. Next, as in FIG. 6C, the punched sheet 418 is stacked so that the punched portion of the punched sheet 418 is fitted over the binding member 417. When stacking of a final sheet is completed, the binding member 417 is deformed to be in a ring shape, and thereby the ring bookbound product as illustrated in FIG. 6D is obtained.

Note that shapes of the sheet stacking portion 415, the members configured therein and the binding member 417 are simplified to describe the mechanism of the bookbinding process according to the present embodiment, and the spacing between the punched holes, the shapes and the like are not limited to the shapes illustrated in FIGS. 6A to 6D. For example, in order to facilitate bending work, a binding member that is formed into a curved shape in advance (binding member in which a part of the binding member is worked into a curved shape in advance to such an extent that the sheet is allowed to be fitted over the binding member) may be used instead of the linear binding member 417 as illustrated in FIGS. 6A to 6D.

Figure 7A:
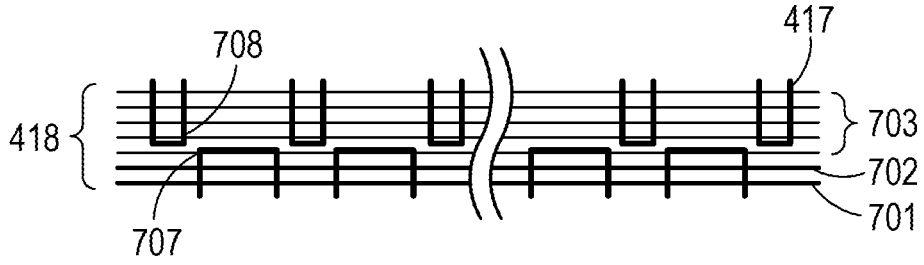
FIGS. 7A and 7B are views describing shapes of binding members of a product obtained as a result of carrying out a bookbinding process.
Figure 7B:
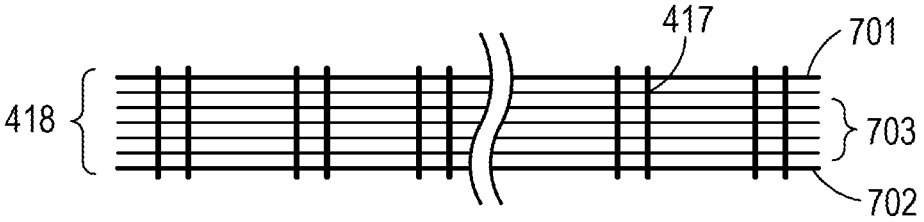

FIGS. 7A and 7B are views for describing the shape of the binding member 417 of a product obtained as a result of carrying out the bookbinding process in the present embodiment. FIG. 7A is a view showing a product from a direction of the binding member of the bound product (an opposite side from a sheet side). FIG. 7A illustrates a state in which a first sheet 701, a second sheet 702 and following sheets 703 are stacked in the sheet stacking portion 415 in the order mentioned, and a binding process is applied. The bookbinding process of the present embodiment is of a method of bundling sheets by the binding member 417 being bent and deformed into a ring shape in a state where the binding member 417 penetrates through the sheets. Accordingly, as illustrated in FIG. 7A, the binding member 417 is formed as a shape in which bottom portions 707 of the binding member 417 and penetration portions (that is, upper portions 708) are alternately disposed.

However, a form in which the bottom portions 707 and the upper portions 708 of the binding member 417 as a resultant product are exposed on an outside of the product is unattractive and is unlikely to be preferred. Therefore, as illustrated in FIG. 7B, a bookbinder flips the initial sheet 701 of the product in an opposite direction of the ring bookbound product after execution of the binding process. Thereby, the state where the bottom portions 707 and the upper portions 708 are exposed as illustrated in FIG. 7A is eliminated, and a product with higher appearance quality can be obtained. Further, the process of flipping the initial sheet 701 in the opposite direction in this way is assumed in advance, and a sheet stacking order of the product is changed. In order that the initial sheet 701 is flipped in the opposite direction after completion of the product, it is necessary to change the order of printing so that the stacking order is a last page, the first page, the second page, . . . , the second page from the last page. The present embodiment includes the configurations in which both of the product in the state illustrated in FIG. 7A and the product in the state as illustrated in FIG. 7B are produced.

Further, the binding member 417 (ring diameter after deformation) with a size, which is set in advance, is placed in the ring bookbinding device 110. On the other hand, the number or a bundle thickness of sheets configuring the bookbound product are variable in accordance with the number of pages of print data and the kind of sheets to be used. In order to obtain ring bookbound products of various bundle thicknesses, the ring bookbinding device 110 of the present embodiment is configured to exchange the binding members 417 of different sizes. Thereby, even the bookbound products of different bundle thicknesses can be properly produced.

Figure 8:
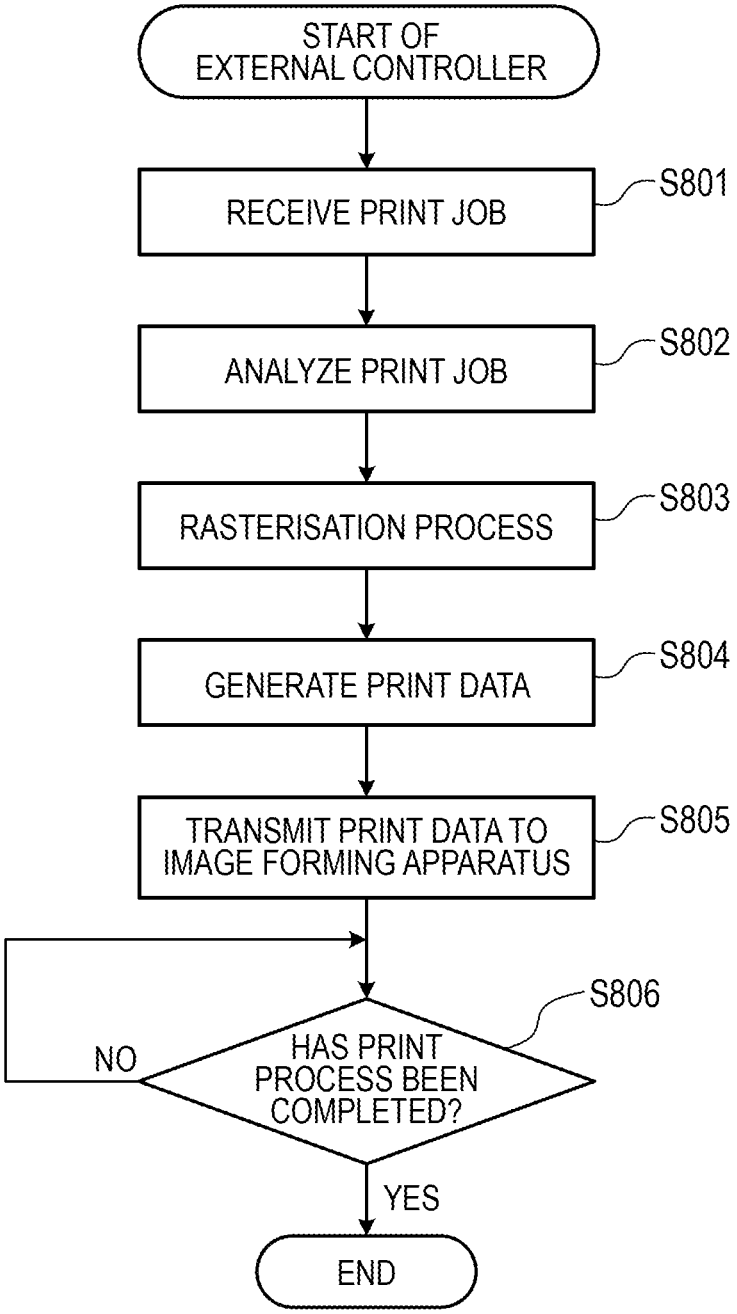
FIG. 8 is a flowchart illustrating a process of the external controller.

Hereinafter, processes of the respective devices configuring the image forming apparatus 101 will be described with use of flowcharts. FIG. 8 is a flowchart illustrating a flow of a process at a time of the external controller 102 receiving print data from the client PC 103, and inputting the print data to the image forming apparatus 101. The process in FIG. 8 is realized by the CPU 208 of the external controller 102 executing the program stored in the memory 209 or the HDD 210.

In S801, when the CPU 208 of the external controller 102 receives the print job inputted from the client PC 103, the CPU 208 advances a process to S802.

In S802, the CPU 208 analyzes the print job received in S801. Analysis of the print data is also called interpret, and extraction of print settings from the received print data, outlining, call of fonts and the like are performed. The print data which the external controller 102 can analyze includes PS (PostScript), PDF (Portable Document Format), PCL (Printer Control Language) and the like. By analysis of the print data in S802, the external controller 102 can determine the sheet size and presence or absence of designation of the ring bookbinding process that are set in the print data.

Next, in S803, the CPU 208 performs a rasterizing process. The rasterizing process is also called RIP (Raster Image Processor) or bitmapping, and generation of a rasterized image to be inputted to the image forming apparatus 101 is performed. In S803, the CPU 208 performs a unique color conversion process or the like of the external controller 102 in accordance with an image setting and the like given to the print data. Thereby, a rasterized image of CMYK or the like that can be interpreted by the image forming apparatus 101 is generated.

Next, in S804, the CPU 208 generates print data to be inputted to the image forming apparatus 101. The print data includes the rasterized image generated in S803 and a print command. The print command includes job names of print jobs, setting of an entire job such as a post process setting, setting information of respective pages and the like.

Next, in S805, the CPU 208 transmits the print data generated in S804 to the image forming apparatus 101. Specifically, the print command is transmitted to the image forming apparatus 101 through the internal LAN 105, and the rasterized image is transmitted to the image forming apparatus 101 through the video cable 106.

Next, in S806, the CPU 208 determines whether or not the image forming apparatus 101 completes the print process. The CPU 208 monitors a printing situation of the image forming apparatus 101 by performing communication via the internal LAN, and displays the printing situation on the display 205. For example, when the CPU 208 receives a printing completion notice corresponding to the print data transmitted in S805 from the image forming apparatus 101, the CPU 208 determines that printing is completed. When the CPU 208 determines that printing is not completed yet (NO in S806), the CPU 208 continues monitoring completion of printing in S806. When the CPU 208 determines that printing is completed (YES in S806), the CPU 208 ends the process of the present flowchart.

Figure 9:
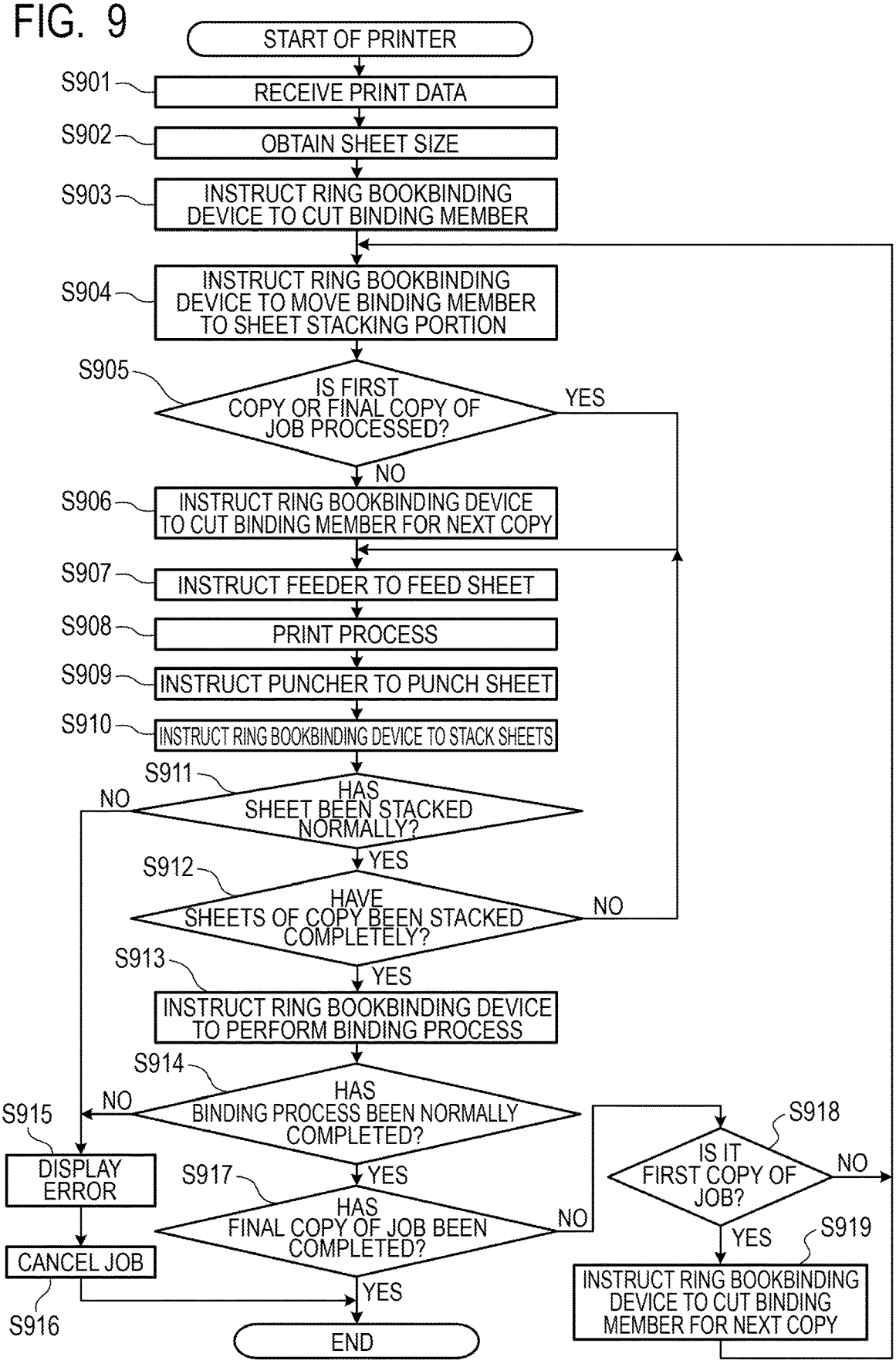
FIG. 9 is a flowchart illustrating a process of a printer of embodiment 1.

FIG. 9 is a flowchart illustrating an example of a flow of a process of the printer 108 of the image forming apparatus 101 of embodiment 1 receiving print data including the ring bookbinding process instruction from the external controller 102 and printing the print data. The process in FIG. 9 is realized by the CPU 228 of the printer 108 executing the program stored in the memory 229 or the HDD 227.

When the CPU 228 of the printer 108 receives the print data inputted from the external controller 102 in S901, the CPU 228 advances the process to S902.

In S902, the CPU 228 analyzes the print data received in S901, and acquires sheet size information from the print data.

Next, in S903, the CPU 228 instructs the ring bookbinding device 110 to cut the binding member. The instruction to cut the binding member in S903 includes the sheet size information set to the print data. This is because the ring bookbinding device 110 cuts the binding member in accordance with the sheet size. The ring bookbinding device 110 draws out the binding member 417 by a length that is necessary for working the sheet from the holding portion 419 based on the instruction to cut from the CPU 228, cuts the binding member 417, and moves the cut binding member to the binding member supply portion 420.

Next, in S904, the CPU 228 instructs the ring bookbinding device 110 to move the binding member to the sheet stacking portion 415. The ring bookbinding device 110 moves the binding member 417 to a predetermined position of the stacking portion 415 from the binding member supply portion 420 based on the instruction to move. Thereby, preparation for stacking the sheets on the stacking portion 415 is made.

Next, in S905, the CPU 228 determines whether or not the present process is a process of a first copy (first sheet bundle) or a final copy (first sheet bundle) of a job corresponding to the print data received in S901. When the CPU 228 determines that the present process is the process of the first copy or the final copy of the job (YES in S905), the CPU 228 advances the process to S907. When the CPU 228 determines that the present process is neither the process of the first copy nor the final copy of the job (NO in S905), the CPU 228 advances the process to S906.

In S906, the CPU 228 instructs the ring bookbinding device 110 to perform a cutting process of the binding member for a next copy (next sheet bundle). The reason why the instruction to cut the binding member for the next copy is issued in S906 is to shorten a time required for the cutting process of the binding member at the time of printing the next copy. Here, the reason why the instruction to cut the binding member for the next copy is not issued when the present process is the process of the first copy is that there is no guarantee that the binding process of the product of the first copy is completed normally. If an error occurs for the reason of the number of sheets being too large or the like halfway through the binding process of the product of the first copy, the print job is cancelled, and the binding member for the next copy which is cut in advance needs to be removed, and the binding member which is cut is wasted. Further, the reason why the instruction to cut the binding member for the next copy is not issued when the present process is the process of the final copy is that when the sheet size of the next job differs from the size of the binding member which is cut, the binding member cannot be used in the next job. If the next job is a ring bookbinding job of a different sheet size, it is necessary to remove the binding member which is cut in advance, and the binding member which is cut is wasted.

Next, in S907, the CPU 228 instructs the feeder 107 to feed sheets. The feeding instruction in S907 includes information indicating from which feeding portion of the plurality of feeding portions the sheets are fed. The CPU 228 designates a suitable feeding portion of the feeder 107 in accordance with a remaining amount of sheets in the feeder 107, the kind of sheets, a sheet size and the like that are set to the print job. By the instruction to feed sheets in S907, the feeder 107 feeds the sheets to be used in printing, and conveys the sheets to the printer 108.

Next, in S908, the CPU 228 executes a print process. In the print process in S908, a laser exposure process by the laser exposure portion 233, an image forming process by the image forming portion 234 and the fixing process by the fixing portion 235 are performed in accordance with the print data received in S901, and a toner image is transferred onto the sheet. Further, a sheet is fed and conveyed properly by the feed conveyance portion 236 so that printing is performed on one side or both sides of the sheet based on designation of the print data received in S901. The printed sheet is discharged from the printer 108, and is guided to the puncher 109.

Next, in S909, the CPU 228 instructs the puncher 109 to perform a punching process. In accordance with the instruction to perform the punching process in S909, the puncher 109 performs the punching process to the conveyed sheet, and conveys the punched sheet to the subsequent ring bookbinding device 110.

Next, in S910, the CPU 288 instructs the ring bookbinding device 110 to stack the sheet. In response to the instruction to stack sheet in S910, the ring bookbinding device 110 conveys the sheet conveyed from the puncher 109 to the sheet stacking portion 415, and the conveyed sheet is stacked in the state where the binding member 417 penetrates through the sheet.

Next, in S911, the CPU 228 determines whether or not stacking of the sheet instructed in S910 is normally completed. The bookbinding control portion 248 determines whether stacking of the sheet described above is completed normally based on outputs of the plurality of sensors, and notifies the printer 108 of the result. For example, if the thickness of the sheets which are stacked exceeds the sheet thickness capable of being subjected to the binding process by the binding member 417, stacking of the sheets cannot be completed normally. When the CPU 228 determines that stacking of the sheets is completed normally in S911 (YES in S911), the CPU 228 advances the process to S912.

In S912, the CPU 228 determines whether or not the stacking process of sheets configuring one copy of a printed matter (stacking process for one copy) is completed. When the CPU 228 determines that the stacking process of the copy is not completed (NO in S912), the CPU 228 returns the process to S907. Note that for the feed instruction in S907 to the stacking instruction in S910, the processes are repeatedly performed by the number of sheets configuring one copy of the printed matter. Note that the processes from feeding in S907 to stacking in S910 are sequentially performed one by one in the flowchart in FIG. 9, but for high speed of the printing process and control of one side and both sides print, the processes are not always controlled in the order mentioned. For example, a feeding process of a second sheet may be performed before a printing process of a first sheet is started. These are properly controlled by the CPU 228 of the printer 108 in accordance with the settings in the print data.

When the CPU 228 determines that the stacking process for one copy is completed in S912 (YES in S912), the CPU 228 advances the process to S913. In S913, the CPU 228 instructs the ring bookbinding device 110 to perform a binding process. In accordance with the binding process in S913, the ring bookbinding device 110 performs the binding process of deforming and working the binding member 417 into a ring shape in the sheet stacking portion 415, and discharges a product to the product tray 422 via the conveyance path 421.

Next, in S914, the CPU 228 determines whether or not the binding process instructed in S913 is completed normally. The bookbinding control portion 248 includes a plurality of sensors, determines whether the binding process is completed normally, and notifies the printer 108 of the result. Note that even when it is determined that stacking is normally completed in S911, the binding process cannot be sometimes completed normally in the deformation and working process of the binding member 417, because the sheet thickness exceeds the sheet thickness capable of being subjected to the binding process.

When the CPU 228 determines that the binding process is completed normally in S914 (YES in S914), the CPU 228 advances the process to S917. In S917, the CPU 228 determines whether or not the present process is a process of the final copy of the job. When the CPU 228 determines that the present process is not the process of the final copy of the job (NO in S917), the CPU 228 advances the process to S918.

In S918, the CPU 228 determines whether or not the present process is the process of the first copy of the job. When the CPU 228 determines that the present process is the process of the first copy of the job (YES in S918), the CPU 228 advances the process to S919. In S919, the CPU 228 instructs the ring bookbinding device 110 to cut the binding member for the next copy, and moves the process to S904. The ring bookbinding device 110 controls to perform a cutting process of a binding member to be used in a binding process for the second copy before start of stacking sheets of the second copy, after the binding process of the first copy is completed, in response to the instruction to cut in S919.

When the CPU 228 determines that the present process is not the process of the first copy of the job in S918 (NO in S918), the CPU 228 directly moves the process to S904. In this case, the instruction to perform the binding member cutting process for the next copy is already issued in S906, so that the process in S919 can be omitted.

When the CPU 228 determines that the present process is the process of the final copy of the job in S917 (YES in S917), the CPU 228 ends the process of the present flowchart.

Further, when the CPU 228 determines that stacking of the sheets is not normally completed in S911 (NO in S911), or determines that the binding process is not normally completed in S914 (NO in S914), the CPU 228 advances the process to S915.

In S915, the CPU 228 displays an error screen indicating that the ring bookbinding process is not completed normally on the display 231. FIG. 10 is a diagram illustrating one example of the error screen displayed in S915 in FIG. 9.

When stacking and the binding process of the sheets are not completed normally, the user needs to remove the binding member and the printed sheets under processing. Further, even if the same ring bookbinding process is performed again without changing the settings of the job as a recovery operation, printing is unlikely to be performed normally again. Consequently, the CPU 228 advances the process to S916 after displaying the error screen in S915 in FIG. 9. In S916, the CPU 228 cancels the job under printing, and ends the process of the present flowchart.

Note that the error screen in FIG. 10 notifies the user of a message or the like indicating that the job is to be cancelled because an error occurred during the ring bookbinding process, that it is necessary to remove all the binding members and sheets under processing, and it is necessary to check the job setting and the type of the binding member.

Figure 11A:
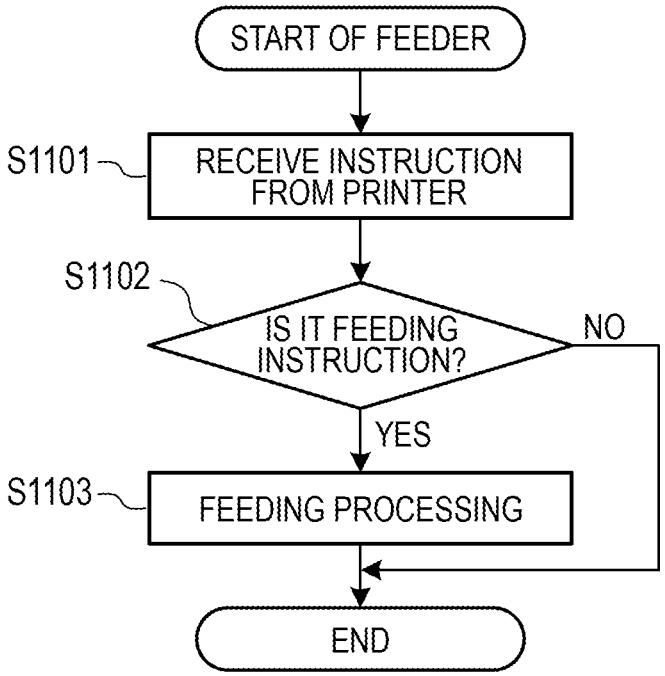
FIG. 11A is a flowchart illustrating a process of a feeder of embodiment 1.

FIG. 11A is a flowchart illustrating a flow of a process of the feeder 107 of the image forming apparatus 101 receiving an instruction to feed sheets from the printer 108 and performing a feeding process. The process in FIG. 11A is realized by the CPU 218 of the feeder 107 executing the program stored in the RAM 219 or the ROM 221.

When the CPU 218 of the feeder 107 receives an instruction from the printer 108 in S1101, the CPU 218 advances the process to S1102. In S1102, the CPU 218 determines whether or not the instruction received in S1101 is a feeding instruction. When the CPU 218 determines that the instruction received in S1101 is not the feeding instruction (NO in S1102), the CPU 218 ends the process of the present flowchart.

When the CPU 218 determines that the instruction received in S1101 is the feeding instruction in S1102 (YES in S1102), the CPU 218 advances the process to S1103. In S1103, the CPU 218 feeds and conveys sheets from the feeding portion in accordance with feeding portion information included in the feeding instruction, and guides the sheets to the printer 108. After the process in S1103, the CPU 218 ends the process of the present flowchart.

Figure 11B:
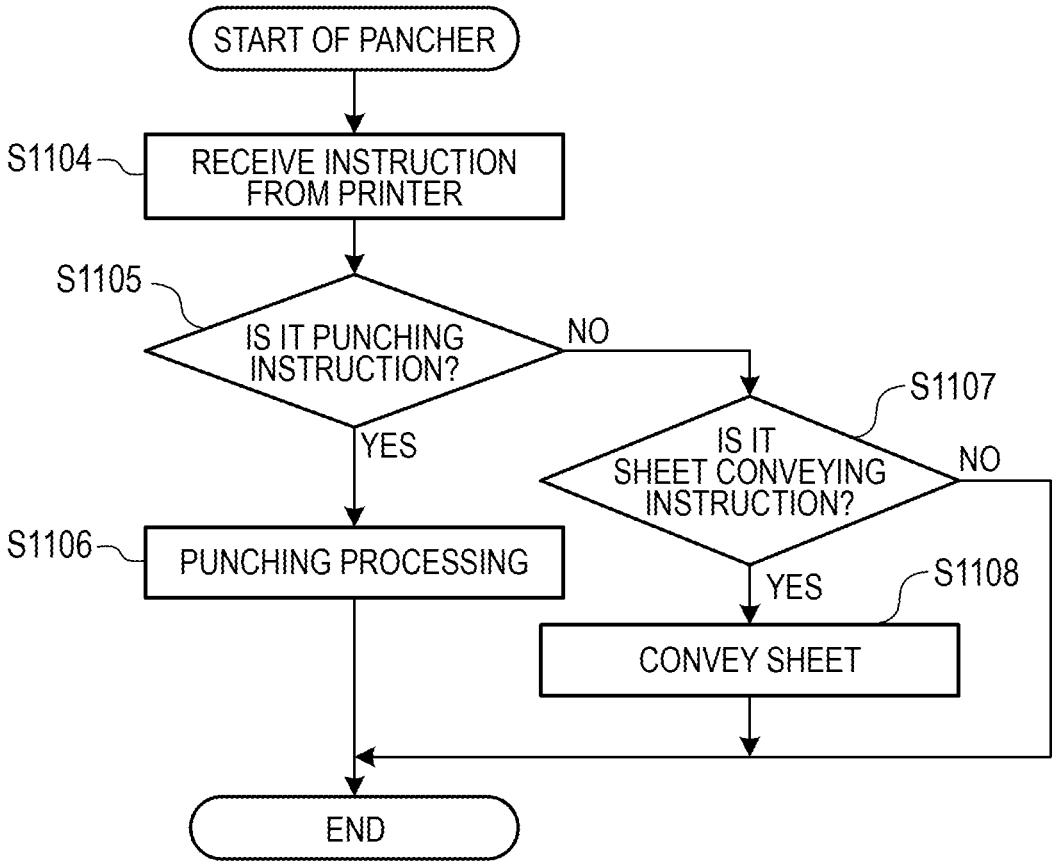
FIG. 11B is a flowchart illustrating a process of the puncher of embodiment 1.

FIG. 11B is a flowchart illustrating a flow of a process of the puncher 109 of the image forming apparatus 101 receiving an instruction from the printer 108 and performing a punching process or a conveyance process. The process in FIG. 11B is realized by the CPU 239 of the puncher 109 executing a program stored in the RAM 240 or the ROM 241.

When the CPU 239 of the puncher 109 receives an instruction from the printer 108 in S1104, the CPU 239 advances a process to S1105. In S1105, the CPU 239 determines whether or not the instruction received in S1104 is a punching instruction. When the CPU 239 determines that the instruction received in S1104 is the punching instruction (YES in S1105), the CPU 239 advances the process to S1106. In S1106, the CPU 239 passes the sheet conveyed from the printer 108 via the conveyance path 405 to perform a punching process in the working portion 412, conveys the sheet to the ring bookbinding device 110 via the conveyance path 406, and ends the process of the present flowchart.

When the CPU 239 determines that the instruction received in S1104 is not the punching instruction in S1105 (NO in S1105), the CPU 239 advances the process to S1107.

In S1107, the CPU 239 determines whether or not the instruction received in S1104 is a sheet conveying instruction. When the CPU 239 determines that the instruction received in S1104 is the sheet conveying instruction (YES in S1107), the CPU 239 advances the process to S1108. In S1108, the CPU 239 conveys the sheet conveyed from the printer 108 to the ring bookbinding device 110 via the conveyance path 404, and ends the process of the present flowchart.

When the CPU 239 determines that the instruction received in S1104 is not the sheet conveying instruction in S1107 (NO in S1107), the CPU 239 ends the process of the present flowchart.

Figure 11C:
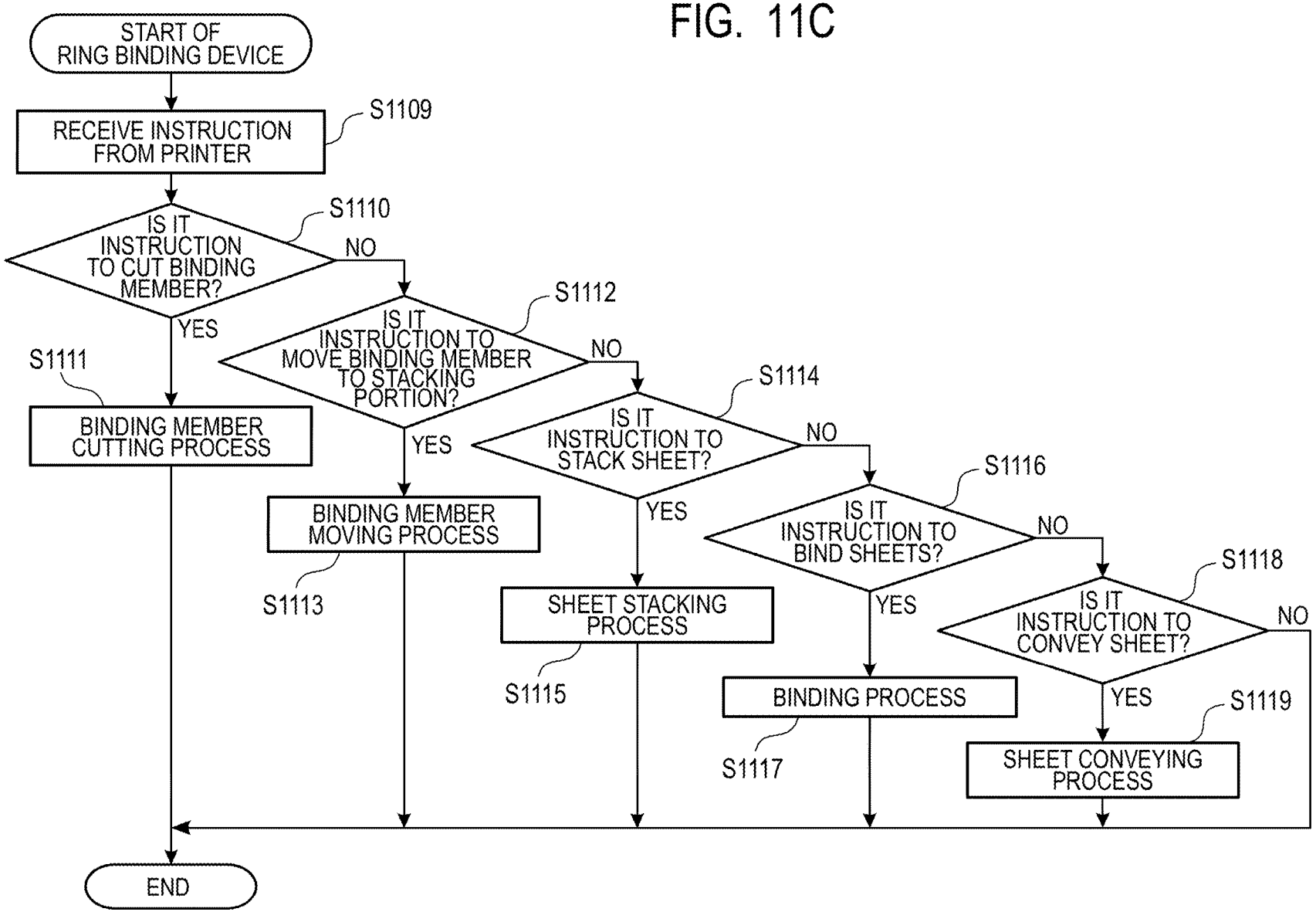
FIG. 11C is a flowchart illustrating a process of a ring bookbinding device of embodiment 1.

FIG. 11C is a flowchart illustrating a flow of a process of the ring bookbinding device 110 of the image forming apparatus 101 receiving an instruction concerning ring bookbinding from the printer 108, and performing a ring bookbinding process. The process in FIG. 11C is realized by the CPU 245 of the ring bookbinding device 110 executing a program stored in the RAM 246 or the ROM 247.

When the CPU 245 of the ring bookbinding device 110 receives an instruction from the printer 108 in S1109, the CPU 245 advances the process to S1110. In S1110, the CPU 245 determines whether or not the instruction received in S1109 is an instruction to cut the binding member. When the CPU 245 determines that the instruction received in S1109 is the instruction to cut the binding member (YES in S1109), the CPU 245 advances the process to S1111. In S1111, the CPU 245 performs a binding member cutting process. Note that the instruction to cut the binding member also includes sheet size information. The CPU 245 draws out the binding member by a length necessary to work the sheet from the binding member holding portion 419 in accordance with the sheet size information, thereafter cuts the binding member, and supplies the cut binding member to the binding member supply portion 420. After S1111, the CPU 245 ends the process of the present flowchart.

When the CPU 245 determines that the instruction received in S1109 is not the instruction to cut the binding member in S1110 (NO in S1109), the CPU 245 advances the process to S1112. In S1112, the CPU 245 determines whether or not the instruction received in S1109 is an instruction to move the binding member to the stacking portion. When the CPU 245 determines that the instruction received in S1109 is the instruction to move the binding member to the stacking portion (YES in S1112), the CPU 245 advances the process to S1113. In S1113, the CPU 245 moves the binding member of the binding member supply portion 420 to a predetermined position of the sheet stacking portion 415. Thereby, preparation for stacking the sheet is made. After S1113, the CPU 245 ends the process of the present flowchart.

When the CPU 245 determines that the instruction received in S1109 is not the instruction to move the binding member to the stacking portion in S1112 (NO in S1112), the CPU 245 advances the process to S1114. In S1114, the CPU 245 determines whether or not the instruction received in S1109 is an instruction to stack the sheet. When the CPU 245 determines that the instruction received in S1109 is the instruction to stack the sheet (YES in S1114), the CPU 245 advances the process to S1115. In S1115, the CPU 245 conveys the sheet that is conveyed from the puncher 109 and has a punching process applied thereto to the sheet stacking portion 415, and stacks the sheet so that the punched portions of the sheet penetrate through the binding member 417. After S1115, the CPU 245 ends the process of the present flowchart.

When the CPU 245 determines that the instruction received in S1109 is not the instruction to stack the sheet in S1114 (NO in S1114), the CPU 245 advances the process to S1116. In S1116, the CPU 245 determines whether or not the instruction received in S1109 is an instruction to perform a binding process. When the CPU 245 determines that the instruction received in S1109 is the instruction to perform the binding process (YES in S1116), the CPU 245 advances the process to S1117. In S1117, the CPU 245 completes a bookbound product by deforming and working the binding member 417 into a ring shape, and conveys the bookbound product to the product tray 422 via the conveyance path 421. After S1117, the CPU 245 ends the process of the present flowchart.

When the CPU 245 determines that the instruction received in S1109 is not the instruction to perform the binding process in S1116 (NO in S1116), the CPU 245 advances the process to S1118. In S1118, the CPU 245 determines whether or not the instruction received in S1109 is a sheet conveying instruction. When the CPU 245 determines that the instruction received in S1109 is the sheet conveying instruction (YES in S1118), the CPU 245 advances the process to S1119. In S1119, the CPU 245 conveys the sheet conveyed from the puncher 109 to the discharge device 111 in the subsequent stage via the conveyance path 409. After S1119, the CPU 245 ends the process of the present flowchart.

When the CPU 245 determines that the instruction received in S1109 is not the sheet conveying instruction in S1118 (NO in S1118), the CPU 245 ends the process of the present flowchart.

Figures 12A, 12B:
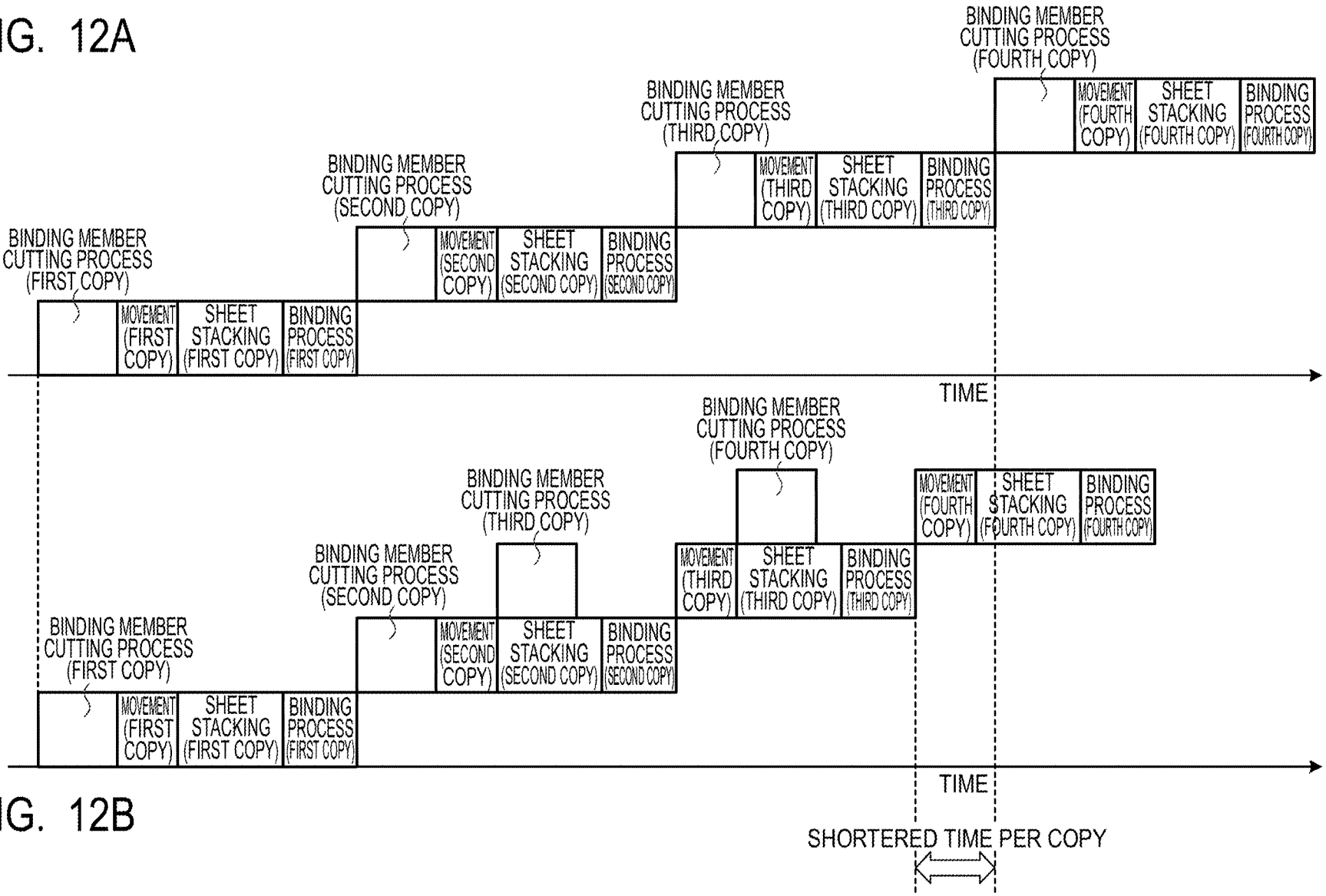
FIGS. 12A and 12B are diagrams illustrating a processing time and a shortened time per copy in embodiment 1.

FIGS. 12A and 12B are diagrams illustrating a processing time and a shortened time per copy in embodiment 1. FIG. 12A illustrates a time of a process in the ring bookbinding device 110 in a case where the cutting process of the binding member is performed after completion of the binding process of a previous copy unlike the process of the present embodiment. FIG. 12B illustrates a time of the process in the ring bookbinding device 110 in a case where a cutting process of the binding members of the third and the following copies is performed during sheet stacking of the previous copy by the process of the present embodiment. In FIG. 12B, in the third and the following copies, the processing time required for ring bookbinding of one copy can be made shorter than in the case of FIG. 12A by the processing time of the cutting process of the binding member.

Note that in the present embodiment, an instruction to perform a binding member cutting process for the next copy (S906 in FIG. 9) is performed only when the present job is not for the first copy or the final copy of the job (NO in S905) because of the following reasons. With respect to the first copy, it is required to prevent the cut binding member from being wasted when the binding process is not normally completed. With respect to the final copy, it is required to prevent the cut binding member from being wasted because the sheet size of the next job differs from the sheet size of the job under execution.

When there is a risk of the binding member being wasted in addition to the above, it is also possible to prevent the binding member from being wasted by conducting control of performing no process in S906 in FIG. 9. For example, when there is no sheet in the feeding portion during feeding, and the feeding portion is switched, halfway through the print of a job of performing ring bookbinding process for a plurality of copies, control of not issuing an instruction to perform a binding member cutting process for the next copy is conceivable. The reason is that thicknesses of the sheets differ somewhat between the job under execution and the next job, and when the thickness of a sheet bundle increases in the next job, there is the possibility that the ring bookbinding process cannot be completed normally.

Effect of Embodiment 1

As above, in embodiment 1, in the case where a plurality of copies of bookbound products to which the binding process (ring bookbinding process) is applied are produced, the printer 108 does not instruct to cut the binding member for the next copy before the feeding instruction in the first copy and the final copy. When the current copy is not the first copy and the final copy, the printer 108 instructs to cut the binding member for the next copy before the feeding instruction (S906 in FIG. 9). That is, the printer 108 conducts control not to perform the cutting process of the binding member to be used in the binding process for the next copy during sheet stacking of the first copy and the final copy, but to perform the cutting process of the binding member to be used in the binding process for the next copy during sheet stacking of the second copy and the following copies (which is not the final copy). Thereby, sheet feeding, printing, punching and stacking processes and the like and the binding member cutting process for the next copy can be performed in parallel. Therefore, for the third and the following copies, the processing time necessary for the ring bookbinding printing process per copy can be shortened by the processing time required for the binding member cutting process for the next copy. Further, for the first copy of the job, the instruction (S906) to cut the binding member for the next copy is not performed, whereby even when the ring bookbinding process for the first copy is not normally completed, the binding member which is cut can be prevented from being wasted. In this way, according to the present embodiment, the processing time required for the ring bookbinding printing process of a plurality of copies can be shortened, and the binding member can be prevented from being wasted.

Embodiment 2

In embodiment 1 described above, the instruction to cut the binding member, the instruction to move the binding member to the stacking portion, the instruction to stack the sheet, and the instruction to perform the binding process are configured to be performed individually to the ring bookbinding device 110 by the printer 108, but control thereof may be completed in the ring bookbinding device 110. That is, the printer 108 may control individual processes in the ring bookbinding device 110 in the ring bookbinding device 110 by notifying the ring bookbinding device 110 of sheet information concerning that the sheet to be conveyed to the ring bookbinding device 110 corresponds to a job for a page with what ordinal number in a copy with what ordinal number among jobs for what total number of copies of what total number of pages. Hereinafter, the embodiment will be described.

Hereinafter, a flow of a process in the case where the printer 108 notifies the ring bookbinding device 110 of the sheet information, and individual control is performed in the ring bookbinding device 110 will be described with use of a flowchart. Note that in embodiment 2, a flow of the process at a time of the external controller 102 receiving print data from the client PC 103 and inputting the print data to the image forming apparatus 101 is the same as the process described in embodiment 1 with use of FIG. 8.

Figure 13:
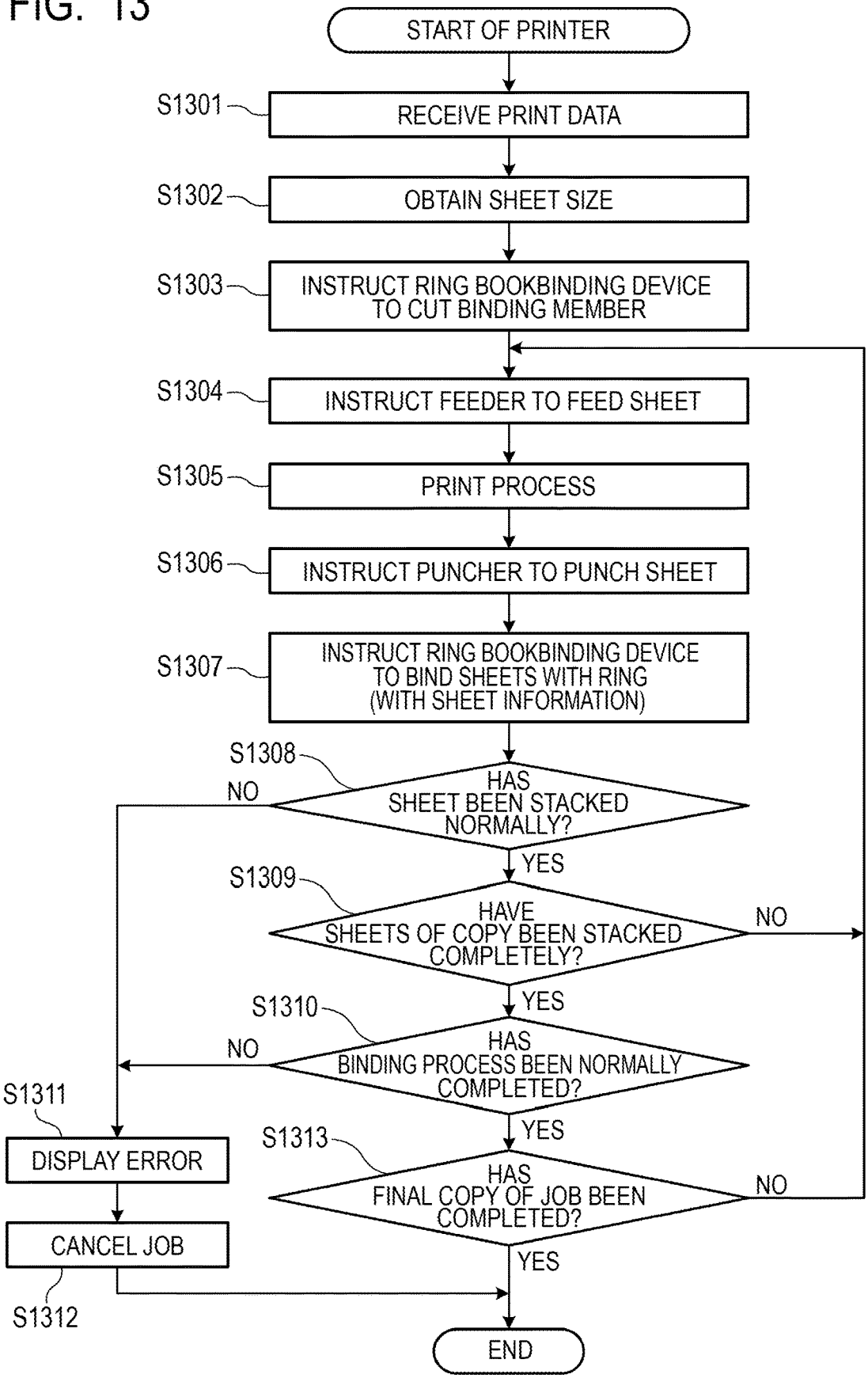
FIG. 13 is a flowchart illustrating a process of a printer in embodiment 2.

FIG. 13 is a flowchart illustrating an example of a flow of a process of the printer 108 of the image forming apparatus 101 receiving print data including an instruction to perform a ring bookbinding process from the external controller 102 and performing printing in embodiment 2. The process in FIG. 13 is realized by the CPU 228 of the printer 108 executing the program stored in the memory 229 or the HDD 227.

When the CPU 228 of the printer 108 receives print data inputted from the external controller 102 in S1301, the CPU 228 advances a process to S1302.

In S1302, the CPU 228 analyzes the print data received in S901, and acquires sheet size information from the print data.

Subsequently, in S1303, the CPU 228 instructs the ring bookbinding device 110 to cut the binding member. As in embodiment 1, the instruction to cut the binding member in S1303 includes the sheet size information set in the print data. The ring bookbinding device 110 draws out the binding member 417 by a length necessary to work sheets from the holding portion 419 and cuts the binding member 417, in accordance with the cut instruction from the CPU 228, and moves the cut binding member to the binding member supply portion 420.

Subsequently, in S1304, the CPU 228 instructs the feeder 107 to feed sheets. The instruction to feed sheets in S1304 includes information concerning from which feeding portion among the plurality of feeding portions the sheets are fed. The CPU 228 designates a suitable feeding portion of the feeder 107 in accordance with the remaining amount of sheets in the feeder 107, the kind of sheets, a sheet size and the like that are set to the print job. Based on the instruction to feed sheets in S1304, a sheet to be used in printing is fed and conveyed in the feeder 107 and is guided to the printer 108.

Next, in S1305, the CPU 228 executes a printing process. In the printing process in S1305, a laser exposure process by the laser exposure portion 233, an image forming process by the image forming portion 234, and a fixing process by the fixing portion 235 are performed in accordance with the print data received in S1301, and a toner image is transferred onto the sheet. Further, based on designation of the print data received in S1301, the sheet is fed and conveyed properly by the feed conveyance portion 236 so that printing is performed onto one side or both sides of the sheet. Subsequently, the printed sheet is discharged from the printer 108 and is guided to the puncher 109.

Next, in S1306, the CPU 228 instructs the puncher 109 to punch the sheet. The puncher 109 punches the conveyed sheet in response to the instruction to punch the sheet from the CPU 228, and conveys the punched sheet to the subsequent ring bookbinding device 110.

Next, in S1307, the CPU 228 instructs the ring bookbinding device 110 to bind sheets with ring. Information on the sheets to be conveyed, information concerning that the sheet to be conveyed corresponds to a sheet with what ordinal number in a copy with what ordinal number, and information indicating the number of copies which is set and the number of sheets configuring one copy are added to the ring bookbinding instruction in S1307. In embodiment 2, the ring bookbinding device 110 executes the cutting process and the binding process of the binding member based on the sheet information added in S1307.

Next, in S1308, the CPU 228 determines whether or not stacking of the sheets executed in accordance with the ring bookbinding instruction in S1307 is completed normally. The bookbinding control portion 248 determines whether stacking of the sheets described above is completed normally based on outputs of the plurality of sensors, and notifies the printer 108 of the result. For example, when a thickness of the stacked sheets exceeds a sheet thickness capable of being bound with the binding member 417, stacking of the sheets cannot be completed normally. When the CPU 228 determines that stacking of the sheets is completed normally in S1308 (YES in S1308), the CPU 228 advances the process to S1309.

In S1309, the CPU 228 determines whether or not a stacking process of the sheets configuring one copy of the printed matter (stacking process of a copy) is completed. When the CPU 228 determines that the stacking process for one copy is not completed yet (NO in S1309), the CPU 228 returns the process to S1304. Note that as for the feeding instruction in S1304 to the ring bookbinding instruction in S1307, the processes are repeatedly performed for the number of sheets configuring one copy of the printed matter. Note that the processes from sheet feeding in S1304 to ring bookbinding in S1307 are sequentially performed one by one in the flowchart in FIG. 13, but the processes are not always controlled in the order mentioned for the purpose of increasing the speed of the printing process, and controlling one-side and both-sides printing. For example, a feeding process of a second sheet may be performed before a printing process of a first sheet is started. These processes are properly controlled by the CPU 228 of the printer 108 in accordance with settings in the print data.

When the CPU 228 determines that the stacking process for the copy is completed (YES in S1309), the CPU 228 advances the process to S1310. In S1310, the CPU 228 determines whether or not the binding process that is executed in accordance with the ring bookbinding instruction in S1307 is completed normally. The bookbinding control portion 248 includes the plurality of sensors, determines whether the binding process is completed normally, and notifies the printer 108 of the result. Note that even when the CPU 228 determines that stacking is completed normally in S1308, the binding process may not be completed normally because the sheet thickness exceeds the sheet thickness capable of being subjected to the binding process in the process of deforming and working the binding member 417. When the CPU 228 determines that the binding process is normally completed in S1310 (YES in S1310), the CPU 228 advances the process to S1313. In S1313, the CPU 228 determines whether or not the present process is a process for a final copy of the job. When the CPU 228 determines that the present process is not the process for the final copy of the job (NO in S1313), the CPU 228 moves the process to S1304.

When the CPU 228 determines that the present process is the process for the final copy of the job in S1313 (YES in S1313), the CPU 228 ends the process of the present flowchart.

Further, when the CPU 228 determines that stacking of the sheets is not completed normally in S1308 (NO in S1308), or when the CPU 228 determines that the binding process is not completed normally in S1310 (NO in S1310), the CPU 228 advances the process to S1311. In S1311, the CPU 228 displays an error screen showing that the ring bookbinding process is not completed normally on the display 231, cancels the job under printing, and ends the process of the present flowchart in S1312. Note that the processes in S1311 and S1312 are the same processes as the processes in S915 and S916 in FIG. 9.

In embodiment 2, the flow of the process of the feeder 107 of the image forming apparatus 101 receiving the feeding instruction from the printer 108 and performing the feeding process is the same as the flow of the process described by using FIG. 11A in embodiment 1. Further, the flow of the process of the puncher 109 of the image forming apparatus 101 receiving the instruction to punch sheets from the printer 108 and performing the punching process is the same as the flow of the process described by using FIG. 11B in embodiment 1.

Figure 14:
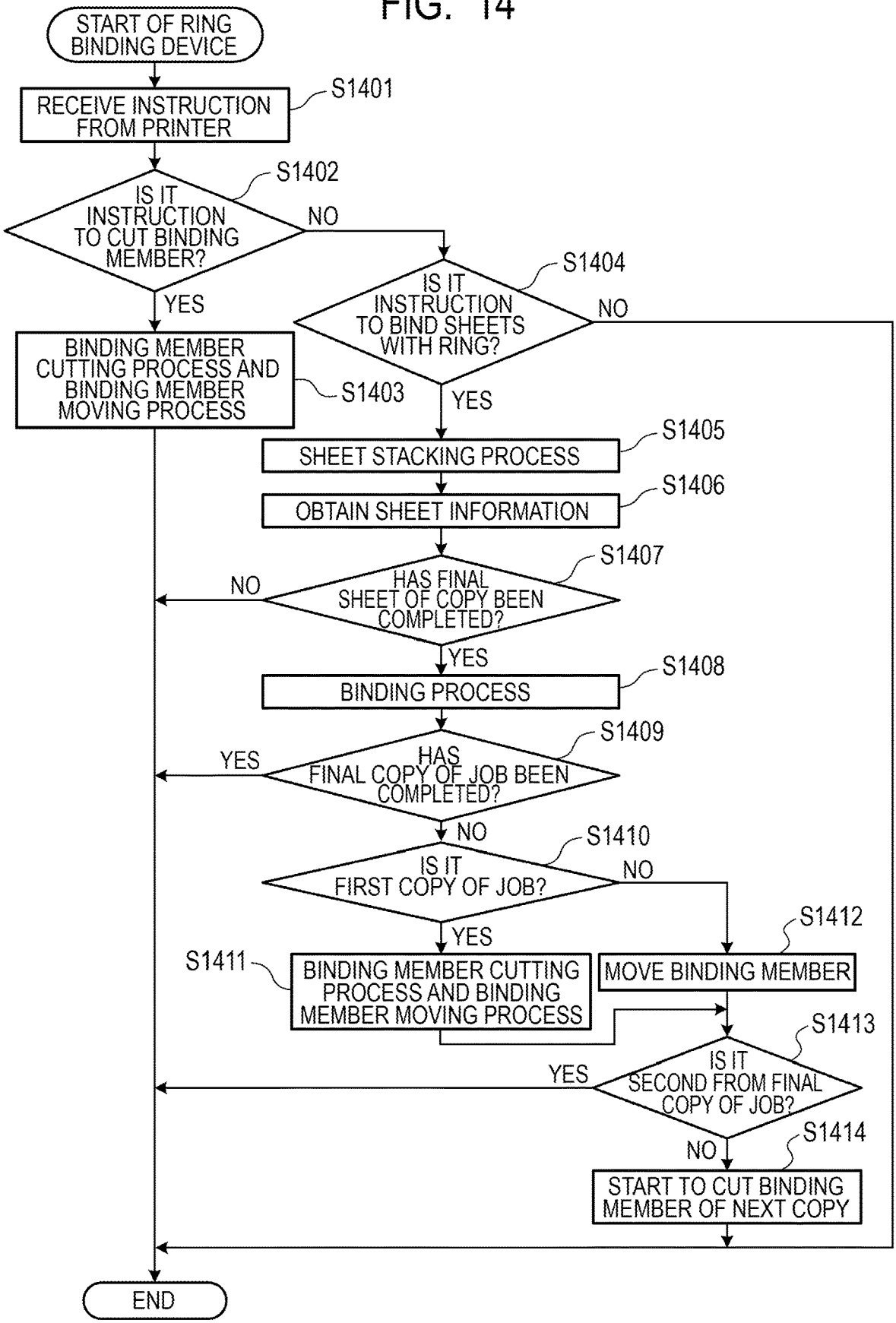
FIG. 14 is a flowchart illustrating a process of a ring bookbinding device in embodiment 2.

FIG. 14 is a flowchart illustrating a flow of a process of the ring bookbinding device 110 of the image forming apparatus 101 receiving the ring bookbinding instruction from the printer 108 and performing a ring bookbinding process in embodiment 2. The process in FIG. 14 is realized by the CPU 245 of the ring bookbinding device 110 executing a program stored in the RAM 246 or the ROM 247.

In embodiment 2, the ring bookbinding device 110 controls movement and the cutting process of the binding member based on the sheet information included in the ring bookbinding instruction in S1307 in FIG. 13, so that as compared with the process in FIG. 11C in embodiment 1, complicated control is required in the ring bookbinding device 110. Details will be described hereinafter.

When the CPU 245 of the ring bookbinding device 110 receives an instruction from the printer 108 in S1401, the CPU 245 advances a process to S1402. In S1402, the CPU 245 determines whether or not the instruction received in S1401 is the instruction to cut the binding member. When the CPU 245 determines that the instruction received in S1401 is the instruction to cut the binding member (YES in S1402), the CPU 245 advances the process to S1403. In S1403, the CPU 245 performs the binding member cutting process and the moving process. The instruction to cut the binding member also includes sheet size information. The CPU 245 draws out the binding member by a length necessary to work sheets from the binding member holding portion 419 and thereafter cuts the binding member in accordance with the sheet size information, and supplies the cut binding member to the binding member supply portion 420. Further, when supply of the binding member is completed, the CPU 245 moves the binding member of the binding member supply portion 420 to a predetermined position of the sheet stacking portion 415. Thereby, preparation for stacking sheets is made. After S1403, the CPU 245 ends the process of the present flowchart.

When the CPU 245 determines that the instruction received in S1401 is not the instruction to cut the binding member in S1402 (NO in S1402), the CPU 245 advances the process to S1404. In S1404, the CPU 245 determines whether or not the instruction received in S1401 is the ring bookbinding instruction. When the CPU 245 determines that the instruction received in S1401 is not the ring bookbinding instruction (NO in S1404), the CPU 245 ends the process of the present flowchart.

When the CPU 245 determines that the instruction received in S1401 is the ring bookbinding instruction (YES in S1404), the CPU 245 advances the process to S1405. In S1405, the CPU 245 conveys the sheet which is conveyed from the puncher 109 and has the punching process applied thereto to the sheet stacking portion 415, and stacks the sheet so that the punched portions of the sheet penetrate through the binding member 417.

Next, in S1406, the CPU 245 acquires the sheet information included in the ring bookbinding instruction which is received in S1401. The acquired sheet information includes information concerning that the sheet to be conveyed corresponds to a sheet with what ordinal number in a copy with what ordinal number.

Next, in S1407, the CPU 245 determines whether or not the sheet stacked in S1405 is a final sheet of the copy based on the sheet information acquired in S1406. When the CPU 245 determines that the stacked sheet is not the final sheet of the copy (NO in S1407), the CPU 245 ends the process of the present flowchart. When the CPU 245 determines that the stacked sheet is the final sheet of the copy (YES in S1407), the CPU 245 advances the process to S1408. In S1408, the CPU 245 completes the bookbound product by deforming and working the binding member 417, and conveys the bookbound product to the product tray 422 via the conveyance path 421.

Next, in S1409, the CPU 245 determines whether or not the present process is the process for the final copy of the job, based on the sheet information acquired in S1406. When the CPU 245 determines that the present process is the process for the final copy of the job (YES in S1409), the CPU 245 ends the process of the present flowchart. When the CPU 245 determines that the present process is not the process for the final copy of the job (NO in S1409), the CPU 245 advances the process to S1410.

In S1410, the CPU 245 determines whether or not the present process is the process for the first copy of the job based on the sheet information acquired in S1406. When the CPU 245 determines that the present process is the process for the first copy of the job (YES in S1410), the CPU 245 advances the process to S1411. This is because when the present process is for the first copy of the job, it is necessary to perform a cutting process of the biding member for the next copy.

In S1411, the CPU 245 performs the cutting process and the moving process of the binding member. The CPU 245 draws out the binding member from the binding member holding portion 419 by a length necessary to work the sheets and thereafter cut the binding member, and supplies the cut binding member to the binding member supply portion 420. When supply of the biding member is completed, the CPU 245 moves the binding member of the binding member supply portion 420 to a predetermined position of the sheet stacking portion 415. Thereby, preparation for stacking sheets is made. After S1411, the CPU 245 advances the process to S1413.

When the CPU 245 determines that the present process is not the process for the first copy of the job in S1410 (NO in S1410), the CPU 245 advances the process to S1412. In S1412, the CPU 245 moves the binding member of the binding member supply portion 420 to the predetermined position of the sheet stacking portion 415, and advances the process to S1413. When the present process is not the process for the first copy, the cutting process of the binding member is already completed in the process in S1414 of the previous copy, so that the CPU 245 directly performs the moving process of the binding member.

In S1413, the CPU 245 determines whether or not the present process is the process for a second copy from the final copy of the job based on the sheet information acquired in S1406. When the CPU 245 determines that the present process is the process for the second copy from the final copy of the job (YES in S1413), the CPU 245 ends the process of the present flowchart. When the CPU 245 determines that the present process is not the process for the second copy from the final copy of the job in S1413 (NO in S1413), the CPU 245 advances the process to S1414. In S1414, the CPU 245 starts the cutting process of the binding member for a next copy, and ends the process of the present flowchart.

In embodiment 2, the instructions from the printer 108 to the ring bookbinding device 110 are only two kinds of instructions that are the binding member cutting process instruction in S1303 and the ring bookbinding instruction in S1307 in FIG. 13. In the process in FIG. 14, it is possible to perform the binding member cutting process for the next copy during stacking of the ring bookbound products of the second and the following copies by properly performing the process of the ring bookbinding device 110 in accordance with the sheet information included in the ring bookbinding instruction.

Note that a processing time and a shortened time per copy in embodiment 2 are the same as those in embodiment 1 described by using FIGS. 12A and 12B. In embodiment 2, in the third copy and the following copies, the processing time of one copy can be also shortened by the process time of the cutting process of the binding member per copy as in embodiment 1.

Effects of Embodiment 2

As above, according to embodiment 2, the printing and stacking processes, and the binding member cutting process for the next copy can be performed in parallel by starting the cutting process of the binding member for the next copy in S1414 in FIG. 14. Consequently, the processing time required for the ring bookbinding printing process of one copy can be shortened by a processing time required for the binding member cutting process for the next copy. Further, the binding member cutting process for the next copy is performed in S1411 after the binding process for the first copy of the job is completed in S1408 in FIG. 14, so that even when the ring bookbinding process of the first copy is not completed normally, the cut binding member can be prevented from being wasted.

As above, according to the respective embodiments, in the ring bookbinding process, in the third copy and the following copies, the binding members to be used in the subsequent copies are cut in advance during sheet stacking. Thereby, the processing time required for the ring bookbinding printing process for a plurality of copies can be shortened, and the biding members which are cut in advance can be also prevented from being wasted.

Note that the configurations and the contents of various data described above are not limited to those mentioned here, but may be configured by various configurations and contents in accordance with applications and purposes. While one embodiment is illustrated above, the present invention can take embodiments, for example, as a system, an apparatus, a method, a program, a storage medium and the like. Specifically, the present invention may be applied to a system configured by a plurality of devices, or may be applied to an apparatus formed of one device. Further, all of configurations combining the above described respective embodiments are also included in the present invention.

OTHER EMBODIMENTS

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-188054, filed Sep. 28, 2017, which is hereby incorporated by reference herein in its entirety.

What is claimed is:

1. An image forming apparatus, comprising:

a printing unit configured to print on a sheet based on print job;

a bookbinding unit including a stack tray on which a plurality of printed sheets are stacked and configured to perform a cutting process of cutting a binding member for binding the plurality of sheets in accordance with a size of the sheets before the sheets on which printing is performed by the printing unit are stacked on the stack tray and perform a binding process of binding stacked sheets by the binding member which is cut; and a controller configured to cause the bookbinding unit to perform the cutting process of the binding member based on sheet size information included in the print job, wherein in a case where the controller controls to produce a plurality of copies of bookbound products on each of which the binding process is performed, the controller controls not to perform the cutting process of the binding member to be used in the binding process of a second copy while sheets are stacking as a first copy, but to perform the cutting process of the binding member to be used in the binding process of a next copy while sheets are stacking as each of the second copy and subsequent copies.

2. The image forming apparatus according to claim 1, wherein in a case where the binding process of the first copy is completed, the controller controls to perform the cutting process of the binding member to be used in the binding process of the second copy before start of stacking of the sheets of the second copy.

3. The image forming apparatus according to claim 2, wherein in a case where the binding process of the first copy is not completed normally, the controller cancels the print job.

4. The image forming apparatus according to claim 3, further comprising a display unit configured to display information, wherein in the case where the binding process of the first copy is not completed normally, the controller causes the display unit to display a message to remove the binding member and the stacked sheets.

5. The image forming apparatus according to claim 1, wherein the controller instructs the bookbinding unit to perform the cutting process of the binding member based on the sheet size information included in the print job.

6. The image forming apparatus according to claim 1, further comprising:

a printer including the printing unit and the controller; and a bookbinding apparatus including the bookbinding unit.

7. The image forming apparatus according to claim 6, wherein the controller does not instruct the bookbinding apparatus to perform the cutting process of the binding member to be used in the binding process of the second copy during the sheet stacking of the first copy, but instructs the bookbinding apparatus to perform the cutting process of the binding member to be used in the binding process of the next copy while the sheets are stacking as each of the second copy and the subsequent copies, and wherein the bookbinding unit performs the cutting process in accordance with the instruction to perform the cutting process from the printer.

8. The image forming apparatus according to claim 1, wherein the bookbinding unit performs ring bookbinding by using the binding member to a plurality of punched sheets.

9. An image forming apparatus connected to a bookbinding apparatus including a stack tray on which a plurality of sheets to be bookbound are stacked and configured to performs a cutting process of cutting a binding member for binding the plurality of sheets in accordance with a size of the sheets before the plurality of sheets are stacked on the stack tray and perform a binding process of binding stacked sheets by the binding member which is cut, the image forming apparatus comprising:

a printing unit configured to print on the sheets based on print job; and a controller configured to transmit size information indicating a size of the sheets to the bookbinding apparatus, the controller instructing, in a case where the controller controls to produce a plurality of copies of bookbound products on each of which the binding process is performed, the bookbinding apparatus not to perform the cutting process of the binding member to be used in the binding process of a second copy while sheets are stacking as a first copy, but to perform the cutting process of the binding member to be used in the binding process of a next copy while sheets are stacking as each of the second copy and subsequent copies.

10. A bookbinding apparatus comprising:

a stack tray on which a plurality of sheets to be bookbound are stacked;

a bookbinding unit configured to perform a cutting process of cutting a binding member for binding the plurality of sheets in accordance with a size of the plurality of sheets to be stacked on the stack tray before the plurality of sheets to be bookbound are stacked on the stack tray and perform a binding process of binding the plurality of sheets stacked on the stack tray by the binding member cut in the cutting process; and a controller configured to control, in a case where the controller controls to produce a plurality of copies of bookbound products on each of which the binding process is performed, the bookbinding unit not to perform the cutting process of the binding member to be used in the binding process of a second copy while sheets are stacking as a first copy, but to perform the cutting process of the binding member to be used in the binding process of a next copy while sheets are stacking as each of the second copy and subsequent copies.

11. A control method of an image forming apparatus including a printing unit configured to print on a sheet based on print job, a bookbinding unit having a stack tray on which a plurality of sheets on which printing is performed by the printing unit are stacked and configured to perform a cutting process of cutting a binding member for binding the plurality of sheets in accordance with a size of the sheets before the plurality of sheets are stacked on the stack tray and perform a binding process of binding stacked sheets by the binding member which is cut, and a controller configured to cause the bookbinding unit to perform the cutting process of the binding member based on sheet size information included in the print job, the control method comprising:

controlling, in a case where the controller controls to produce a plurality of copies of bookbound products on each of which the binding process is performed, not to perform the cutting process of the binding member to be used in the binding process of a second copy while sheets are stacking as a first copy, but to perform the cutting process of the binding member to be used in the binding process of a next copy while sheets are stacking as each of the second copy and subsequent copies.

12. A control method of an image forming apparatus connected to a bookbinding apparatus including a stack tray on which a plurality of sheets to be bookbound are stacked and configured to perform a cutting process of cutting a binding member in accordance with a size of the sheets before the plurality of sheets are stacked on the stack tray and perform a binding process of binding stacked sheets by the binding member which is cut, the control method comprising:

printing on the sheets based on print job;

transmitting size information indicating a size of the sheets to the bookbinding apparatus; and controlling, in a case where the controller controls to produce a plurality of copies of bookbound products to each of which the binding process is performed, to instruct the bookbinding apparatus not to perform the cutting process of the binding member to be used in the binding process of a second copy while sheets are stacking as a first copy, but to perform the cutting process of the binding member to be used in the binding process of a next copy while sheets are stacking as each of the second copy and subsequent copies.

13. A control method of a bookbinding apparatus including a stack tray on which a plurality of sheets to be bookbound are stacked, and a bookbinding unit configured to perform a cutting process of cutting a binding member for binding the plurality of sheets in accordance with a size of the plurality of sheets before the plurality of sheets to be bookbound are stacked on the stack tray and perform a binding process of binding the plurality of sheets stacked on the stack tray by the binding member cut in the cutting process, the control method comprising:

controlling, in a case where the controller controls to produce a plurality of copies of bookbound products on each of which the binding process is performed, the bookbinding unit not to perform the cutting process of the binding member to be used in the binding process of a second copy while sheets are stacking as a first copy, but to perform the cutting process of the binding member to be used in the binding process of a next copy while sheets are stacking as each of the second copy and subsequent copies.

* * * * *